US012735775B2

(12) United States Patent
Ishii

(10) Patent No.: US 12,735,775 B2
(45) Date of Patent: Sep. 15, 2026

(54) PLATED STEEL MATERIAL

(71) Applicant: NIPPON STEEL CORPORATION, Tokyo (JP)

(72) Inventor: Kotaro Ishii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 97 days.

(21) Appl. No.: 18/813,975

(22) Filed: Aug. 23, 2024

(65) Prior Publication Data

US 2026/0055490 A1 Feb. 26, 2026

(51) Int. Cl.

| | |
|---|---|
| ***C22C 30/06*** | (2006.01) |
| ***C22C 18/04*** | (2006.01) |
| ***C22C 21/00*** | (2006.01) |
| ***C23C 2/12*** | (2006.01) |
| ***C23C 2/28*** | (2006.01) |
| *C23C 2/02* | (2006.01) |

(52) U.S. Cl.

CPC ..... *C22C 30/06* (2013.01); *C22C 18/04* (2013.01); *C22C 21/00* (2013.01); *C23C 2/12* (2013.01); *C23C 2/024* (2022.08); *C23C 2/29* (2022.08)

(58) Field of Classification Search

None

See application file for complete search history.

(56) References Cited

U.S. PATENT DOCUMENTS 5,006,420 A * 4/1991 Watanabe ..... C25D 3/565 428/629
5,135,817 A * 8/1992 Shimogori ..... C23C 22/83 428/657
2003/0003321 A1* 1/2003 Sugimaru ..... C23C 2/12 427/431
2016/0319415 A1* 11/2016 Lee ..... C22C 38/06
2021/0032765 A1* 2/2021 Takahashi ..... C25D 3/12
2021/0095368 A1* 4/2021 Fujita ..... C22C 38/42

FOREIGN PATENT DOCUMENTS

| | | | |
|---|---|---|---|
| JP | 2002-47548 | A | 2/2002 |
| JP | 2010-70810 | A | 4/2010 |
| JP | 2012-246547 | A | 12/2012 |
| JP | 2017-66524 | A | 4/2017 |
| SG | 194952 | A1 | 12/2013 |

* cited by examiner

*Primary Examiner* — Seth Dumbris

(74) *Attorney, Agent, or Firm* — Birch, Stewart, Kolasch & Birch, LLP

(57) ABSTRACT

Employed is a plated steel material including: a plated-metal-layer arranged on a surface of a steel material, wherein the plated-metal-layer includes: a lower alloy layer including 22.5% or more of Fe; an intermediate alloy layer including 20.0% or more of Fe and 0.5 to 10.0% of Ni; and an upper plated layer made of a Zn-based alloy including 0 to 5.0% of Fe arranged in this order from a side of the steel material, a thickness of the lower alloy layer is 5 μm or more, a thickness of the intermediate alloy layer is 1.0 μm or more, and a total thickness thereof is 6 μm or more, the lower alloy layer includes 5.0 to 30.0% of Zn, 30.0 to 55.0% of Al, 22.5 to 50.0% of Fe, 0 to 10.0% of Si, 0 to less than 0.5% of Ni, 0 to 1.0% of Mg, and a balance including impurities, and the intermediate alloy layer includes 5.0 to 35.0% of Zn, 25.0 to 60.0% of Al, 20.0 to 45.0% of Fe, 0 to 10.0% of Si, 0.5 to 10.0% of Ni, 0 to 1.0% of Mg, and a balance including impurities.

3 Claims, 10 Drawing Sheets

PLATED STEEL MATERIAL

TECHNICAL FIELD

The present invention relates to a plated steel material.

BACKGROUND ART

Steel structures are used in the fields of civil engineering and infrastructure. In particular, in an area with severe corrosion environment, such as a coastal area or an area where snow melting salt is sprayed, stainless steel materials have been used as the material of the steel structure in order to suppress corrosion for a long period of time and maintain the steel structure.

On the other hand, since the stainless steel material contains expensive alloy elements such as Cr or Ni, it is a problem that installation of the steel structure using the stainless steel material is costly. Therefore, more inexpensive plated steel sheets (for instance, a Zn—Al—Mg-based plated steel material) have recently been used as the material of the steel structure.

Incidentally, when a large steel structure or a pipe-shaped steel structure is manufactured using the plated steel sheet as the material, it is necessary that the plated steel sheet is cut into a predetermined shape, the cut plated steel sheets are joined by welding or the like, and thereby the steel structure is manufactured. However, since the plated layer in a weld may disappear during welding, the corrosion resistance of the steel structure may be insufficient after completion. In addition, the steel structure may have a remaining cut end surface portion of the plated steel sheet, and corrosion may occur from the cut end surface portion as an initiating point. Therefore, in order to ensure the corrosion resistance of a steel structure, a steel structure is manufactured using a steel sheet, a steel pipe, a shaped steel, or the like as the material, and then subjected to a post-plating treatment (dipping plating treatment).

As the post-plating treatment, hot-dip Zn plating treatment has been widely used for a long time, and recently, Zn—Al—Mg-based plating treatment has also been used in order to improve corrosion resistance.

On the other hand, in the post-plating treatment (Zn—Al—Mg-based plating treatment or the like) other than the hot-dip Zn plating treatment, a plating component such as Al or Mg may inhibit reactivity between the plating bath and the flux, leading to poor adhesion of the plated layer. Therefore, as disclosed in Patent Document 1 (Japanese Unexamined Patent Application, First Publication No. 2010-70810) or Patent Document 2 (Japanese Unexamined Patent Application, First Publication No. 2002-47548), a two-stage plating method is employed for plating, in which the steel material is subjected to the hot-dip Zn plating treatment as the first plating treatment, and then the steel material is dipped in the Zn—Al—Mg-based plating bath as the second plating treatment.

However, the two-stage plating method has a disadvantage that the plated layer formed in the first plating treatment affects in some way the plated layer-forming reaction during the second plating treatment. As a result, in the plated layer, the microstructure of the alloy layer adjacent to the steel material becomes a mixed phase structure in which an island-like or mesh-like Al—Fe-based alloy and a Zn—Al—Mg-based alloy are mixed, instead of a homogeneous structure consisting of the Al—Fe-based alloy. As a result, the barrier effect derived from the homogeneous Al—Fe-based alloy structure is reduced, and the corrosion resistance of the entire plated layer may be reduced.

In addition, the two-stage plating method requires steps of dipping the steel material twice in two different plating baths, and thus may be costly compared with the one-stage plating method.

Some methods in which the Zn—Al—Mg-based plating is performed in the one-stage method have been also disclosed. For instance, Patent Document 3 (Japanese Unexamined Patent Application, First Publication No. 2017-66524) discloses that growth of the alloy layer is controlled by an addition of Cr. However, it is difficult to add Cr into the plating bath, and composition control may be difficult.

CITATION LIST

Patent Documents

Patent Document 1
Japanese Unexamined Patent Application, First Publication No. 2010-70810
Patent Document 2
Japanese Unexamined Patent Application, First Publication No. 2002-47548
Patent Document 3
Japanese Unexamined Patent Application, First Publication No. 2017-66524

SUMMARY OF INVENTION

Technical Problem

The present invention has been made in consideration of the above circumstances, and an object thereof is to provide a plated steel material having more excellent corrosion resistance than conventional techniques.

Solution to Problem

In order to solve the above problem, the present invention adopts the following features.

[1] A plated steel material including: a steel material; and a plated-metal-layer arranged on a surface of the steel material, wherein the plated-metal-layer includes: a lower alloy layer including 22.5% or more of Fe; an intermediate alloy layer including 20.0% or more of Fe and 0.5 to 10.0% of Ni; and an upper plated layer made of a Zn-based alloy including 0 to 5.0% of Fe arranged in this order from a side of the steel material, a thickness of the lower alloy layer is 5 μm or more, a thickness of the intermediate alloy layer is 1.0 μm or more, and a total thickness of the lower alloy layer and the intermediate alloy layer is 6 μm or more, the lower alloy layer includes, as a chemical composition, in terms of mass %, 5.0 to 30.0% of Zn,
30.0 to 55.0% of Al,
22.5 to 50.0% of Fe,
0 to 10.0% of Si,
0 to less than 0.5% of Ni,
0 to 1.0% of Mg, and
a balance including impurities, and the intermediate alloy layer includes, as a chemical composition, in terms of mass %, 5.0 to 35.0% of Zn,
25.0 to 60.0% of Al, 20.0 to 45.0% of Fe,
0 to 10.0% of Si,
0.5 to 10.0% of Ni,
0 to 1.0% of Mg,
0 to 2.0% in total of at least one element selected from a group consisting of Ca, Sn, Bi, In, Y, La, Ce, Sr, B, P, Cr, Ti, Co, V, Nb, Cu, Mn, Mo, W, Zr, Ag, Li, Na, K, and Ba, and
a balance including impurities.

[2] The plated steel material according to [1], wherein the upper plated layer includes, as a chemical composition, in terms of mass %,
6.0 to 25.0% of Al,
more than 3.0 to 12.5% of Mg,
0.001 to less than 0.5% of Ni,
0 to 1.5% of Si,
0 to 3.0% of Ca,
0 to 3.0% of Sn,
0 to 1.0% of Bi,
0 to 1.0% of In,
0 to 0.5% of Y,
0 to 0.5% of La,
0 to 0.5% of Ce,
0 to 0.5% of Sr,
0 to 1.0% of B,
0 to 0.5% of P,
0 to 0.25% of Cr,
0 to 0.25% of Ti,
0 to 0.25% of Co,
0 to 0.25% of V,
0 to 0.25% of Nb,
0 to 1.0% of Cu,
0 to 0.25% of Mn,
0 to 0.25% of Mo,
0 to 0.25% of W,
0 to 0.25% of Zr,
0 to 1.0% of Ag,
0 to 0.5% of Li,
0 to 0.05% of Na,
0 to 0.05% of K,
0 to 0.25% of Ba,
0 to 5.0% of Fe, and
a balance including more than 50% of Zn and impurities.

[3] The plated steel material according to [2], wherein the upper plated layer satisfies a following formula (1) and a following formula (2), $$Mg/Al \leq 0.5 \quad (1)$$

$$2 \times Ca + Sr + Y + La + Ce \geq 0.05, \quad (2)$$

herein, in the formula (1) and the formula (2), each of Mg, Al, Ca, Sr, Y, La, and Ce is a content (mass %) in the upper plated layer, and substituted with 0 when the element is not included.

Advantageous Effects of Invention

According to the present invention, it is possible to provide a Zn—Al—Mg-based plated steel material having more excellent corrosion resistance than conventional techniques. As a result, it is possible to realize a steel structure that is capable of inexpensively and stably exhibiting corrosion resistance even under severe corrosion resistance environment.

DESCRIPTION OF EMBODIMENTS

Figure 1A:
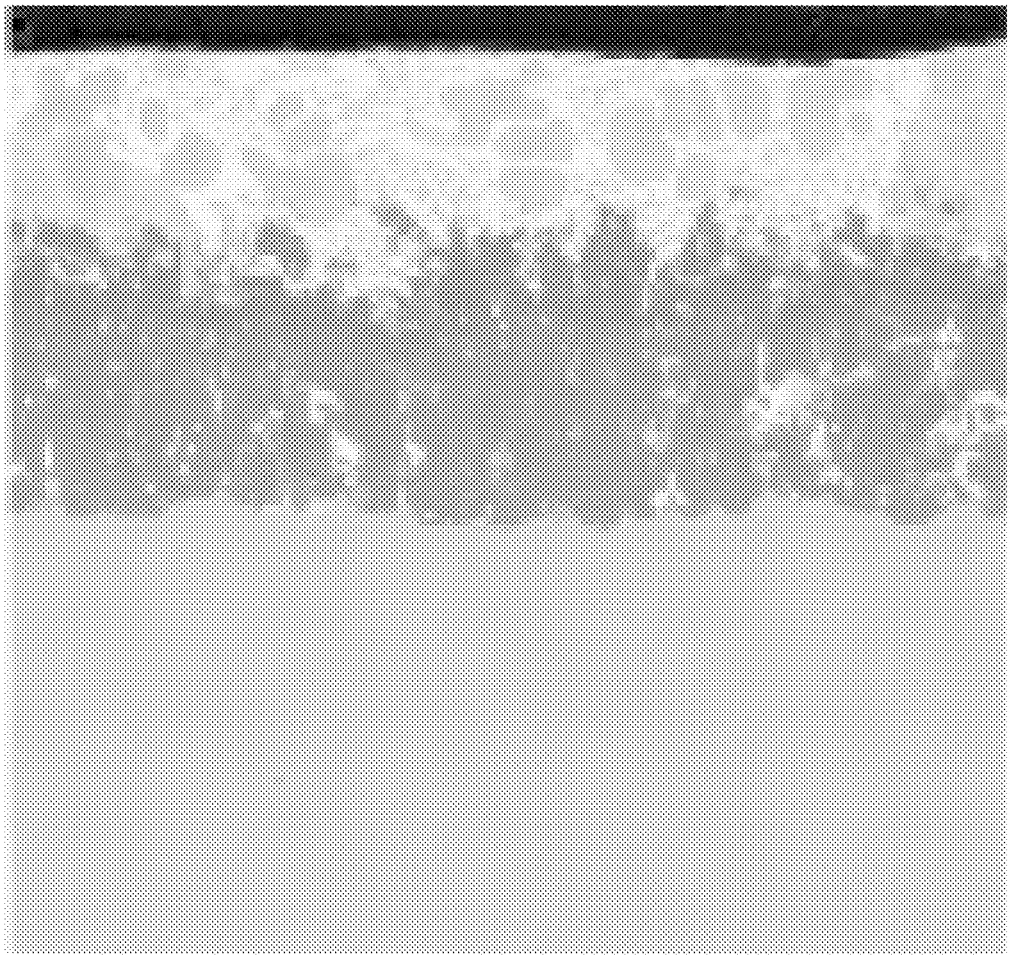
FIG. 1A is an illustration explaining a method for measuring a total thickness of an intermediate alloy layer and a lower alloy layer, and is a SEM micrograph showing the cross section of a plated-metal-layer.

In general, when a Zn-based plated layer is formed by the hot-dip plating method, the surface of a steel material is treated with a flux in order to enhance reactivity between the steel material and plating bath. In a general flux treatment, an aqueous solution containing zinc chloride and ammonium chloride is applied to the steel material surface to adhere a flux coating on the steel material surface. Then, after the flux treatment, the steel material is dipped in a hot-dip plating bath to obtain a hot-dip plated layer. However, when a Zn—Al—Mg-based plated layer is formed using a flux containing the ammonium chloride ($NH_4Cl$), in some cases, Mg in the plating bath and Cl (chlorine) in the flux react with each other to form halides such as magnesium chloride and aluminum chloride, and these halides become flux residue and firmly adhere to the steel material surface to cause bare spots. In addition, when the flux residue such as halides remains in the plated layer, the corrosion resistance of the plated layer may be deteriorated. Therefore, conventionally, in order to stably manufacture the Zn—Al—Mg-based plated layer excellent in the corrosion resistance without causing bare spots, the so-called two-stage plating method has been used to manufacture the plated steel material, in which a hot dip zinc-plated layer is formed in advance on the surface of the steel material, and then the Zn—Al—Mg-based plated layer is formed by the hot-dip plating method.

In order to reduce the burden in manufacturing the plated steel material, the present inventor has studied to manufacture the Zn—Al—Mg-based plated steel material excellent in the corrosion resistance by using the one-stage plating method. As a result, the present inventors have found that, when the hot-dip plating bath includes a small amount of Ni, the occurrence of bare spots can be suppressed and the corrosion resistance of the plated layer can be significantly improved as compared with the prior art.

Hereinafter, the plated steel material according to an embodiment of the present invention will be described.

The plated steel material according to the embodiment includes: a steel material; and a plated-metal-layer arranged on a surface of the steel material, wherein the plated-metal-layer includes: a lower alloy layer including 22.5% or more of Fe; an intermediate alloy layer including 20.0% or more of Fe and 0.5 to 10.0% of Ni; and an upper plated layer made of a Zn-based alloy including 0 to 5.0% of Fe arranged in this order from a side of the steel material, a thickness of the lower alloy layer is 5 μm or more, a thickness of the intermediate alloy layer is 1.0 μm or more, and a total thickness of the lower alloy layer and the intermediate alloy layer is 6 μm or more, the lower alloy layer includes, as a chemical composition, in terms of mass %, 5.0 to 30.0% of Zn, 30.0 to 55.0% of Al, 22.5 to 50.0% of Fe, 0 to 10.0% of Si, 0 to less than 0.5% of Ni, 0 to 1.0% of Mg, and 1% or less of a balance including impurities, and the intermediate alloy layer includes, as a chemical composition, in terms of mass %, 5.0 to 35.0% of Zn, 25.0 to 60.0% of Al, 20.0 to 45.0% of Fe, 0 to 10.0% of Si, 0.5 to 10.0% of Ni, 0 to 1.0% of Mg, 0 to 2.0% in total of at least one element selected from a group consisting of Ca, Sn, Bi, In, Y, La, Ce, Sr, B, P, Cr, Ti, Co, V, Nb, Cu, Mn, Mo, W, Zr, Ag, Li, Na, K, and Ba, and a balance including impurities.

In the plated steel material according to the embodiment, the upper plated layer preferably includes, as a chemical composition, in terms of mass %, 6.0 to 25.0% of Al, more than 3.0 to 12.5% of Mg, 0.001 to less than 0.5% of Ni, 0 to 1.5% of Si, 0 to 3.0% of Ca, 0 to 3.0% of Sn, 0 to 1.0% of Bi, 0 to 1.0% of In, 0 to 0.5% of Y, 0 to 0.5% of La, 0 to 0.5% of Ce, 0 to 0.5% of Sr, 0 to 1.0% of B, 0 to 0.5% of P, 0 to 0.25% of Cr, 0 to 0.25% of Ti, 0 to 0.25% of Co, 0 to 0.25% of V, 0 to 0.25% of Nb, 0 to 1.0% of Cu, 0 to 0.25% of Mn, 0 to 0.25% of Mo, 0 to 0.25% of W, 0 to 0.25% of Zr, 0 to 1.0% of Ag, 0 to 0.5% of Li, 0 to 0.05% of Na, 0 to 0.05% of K, 0 to 0.25% of Ba, 0 to 5.0% of Fe, and a balance including more than 50% of Zn and impurities.

In the plated steel material according to the embodiment, the upper plated layer preferably satisfies a following formula (1) and a following formula (2).

$$Mg/Al \leq 0.5 \quad (1)$$

$$2 \times Ca + Sr + Y + La + Ce \geq 0.05, \quad (2)$$

Herein, in the formula (1) and the formula (2), each of Mg, Al, Ca, Sr, Y, La, and Ce is a content (mass %) in the upper plated layer, and substituted with 0 when the element is not included.

The plated steel material according to the embodiment includes: a steel material; and a plated-metal-layer formed on the surface of the steel material. In the plated-metal-layer, a lower alloy layer, an intermediate alloy layer, and an upper plated layer are arranged in this order from the side of the steel material to the side of the plated steel material surface. A chemical conversion treatment layer may be formed on the upper plated layer of the plated-metal-layer.

In the plated steel material according to the embodiment, the surface of the steel material is covered with the lower alloy layer which is mainly made of an Al—Fe-based alloy. On the lower alloy layer, the intermediate alloy layer, which includes Al, Fe, and Ni, is formed. Further, on the intermediate alloy layer, the upper plated layer, which is excellent in sacrificial anticorrosion ability, is formed. Thereby, the corrosion resistance of the plated steel material is improved. More specifically, the intermediate alloy layer includes Al, Fe, and Ni, and thereby suppresses the occurrence of red rust. In addition, when the intermediate alloy layer is present, a corrosion reaction is less likely to locally proceed in the depth direction of the plated-metal-layer, and initial corrosion of the steel material is suppressed. Further, on the intermediate alloy layer, the upper plated layer, which is mainly made of Zn, is formed. The upper plated layer is excellent in sacrificial corrosion resistance. In addition, the upper plated layer is excellent also in chemical convertibility, so that durability of the steel material can be further enhanced through chemical conversion treatment.

The shape of the steel material constituting the plated steel material according to the embodiment is not particularly limited. It is possible to use steel materials having various shapes such as: a linear shape such as a steel wire; a sheet shape such as a steel sheet; a net shape; a cylindrical shape such as a steel pipe; and a three-dimensional shape such as a rod shape. For instance, it is possible to use from small substrates such as bolts, nuts, and power transmission fittings to large substrates such as high columns, main pillars, protection fences for bridges, road signs, guard fences for roads, fences for rivers, rock fall prevention nets, and steel pipes.

The material quality of the steel material is not particularly limited. As the steel material, for instance, various steel materials, such as general steel, Ni pre-plated steel, Al-killed steel, ultra-low carbon steel, high carbon steel, various high tensile strength steels, and some high alloy steels (a steel containing a reinforcing element such as Ni, Cr, etc.) are applicable. In addition, the steel material is not particularly limited in terms of conditions such as a method for manufacturing the steel material and a method for manufacturing a steel sheet (a hot rolling method, a pickling method, a cold rolling method, or the like). Further, as the steel material, a steel material on which a metal film or an alloy film made of Zn, Ni, Sn, Bi, alloys thereof, or the like and having a thickness of 1 μm or less is formed may be used.

Next, the lower alloy layer, the intermediate alloy layer, and the upper plated layer, each of which constitutes the plated-metal-layer, will be described in detail.

In the following description, the expression "%" of the amount of each element in a chemical composition indicates "mass %". In addition, a numerical range represented by "to" indicates a range including numerical values described before and after "to" as the lower limit and the upper limit. Note that a numerical range in which "more than" or "less than" is attached to the numerical values described before and after "to" indicates a range not including these numerical values as the lower limit or the upper limit.

The "corrosion resistance" indicates a property that the plated-metal-layer itself is hardly corroded. A Zn-based plated layer has a sacrificial corrosion protection function for a steel material. Therefore, in the corrosion process of the plated steel material, the upper plated layer corrodes to turn into white rust before the steel material corrodes, the upper plated layer having turned into white rust is lost, then corrosion proceeds into the intermediate alloy layer and the lower alloy layer in this order, and finally, the steel material corrodes to generate red rust.

The upper plated layer is formed in the plated-metal-layer at the surface side of the plated steel material, and is mainly made of a Zn-based alloy. The upper plated layer is formed by solidifying plating bath on the surface of the steel material, and has a composition substantially equal to that of the plating bath except for some elements.

The lower alloy layer is formed on the surface of the steel material, is adjacent to the steel material surface, and mainly includes an Al—Fe-based alloy.

The intermediate alloy layer is formed between the lower alloy layer and the upper plated layer. The intermediate alloy layer mainly includes an Al—Fe—Ni-based alloy.

In the following description, the lower alloy layer and the intermediate alloy layer may be collectively referred to as an alloy layer.

The Zn-based alloy constituting the upper plated layer may be a Zn—Al—Mg-based alloy in which an alloy element such as Al or Mg is added to Zn. The plated layer made of the Zn—Al—Mg-based alloy has improved the corrosion resistance as compared with an ordinary Zn-plated layer. For instance, the plated layer made of the Zn—Al—Mg-based alloy has the corrosion resistance equivalent to that of a Zn-plated layer even when the thickness thereof is about half the thickness of the Zn-plated layer. Therefore, the upper plated layer is preferably made of the Zn—Al—Mg-based alloy. The Zn—Al—Mg-based alloy is mainly made of a Zn phase, an Al phase, a $Mg_2Zn$ phase, and a ternary eutectic structure [Zn/Al/$MgZn_2$].

When the upper plated layer is made of the Zn—Al—Mg-based alloy, the composition range thereof is preferably as follows.

For the description of the composition range of the upper plated layer, the plating bath to be used for manufacturing the plated-metal-layer will be described. The composition of the upper plated layer is almost the same as the composition of the plating bath except for some elements. The composition of the upper plated layer is different from the composition of the plating bath in elements such as Al and Ni. The amount of Al and the amount of Ni included in the upper plated layer are lower than the amount of Al and the amount of Ni in the plating bath. This is because Al and Ni migrate from the plating bath to the alloy layer (the intermediate alloy layer and the lower alloy layer) after the steel material is pulled up from the plating bath and before the plating bath adhered to the steel material solidifies. Other than the main elements such as Al, Mg, and Zn, each element of Si, Cr, Mn, and Mo tends to migrate to the alloy layer. Similarly to Al and Ni, these elements are included in a smaller amount in the upper plated layer compared with the composition of the plating bath.

Al: 6.0 to 25.0%

When the plated layer is the Zn—Al—Mg-based alloy, as a microstructure, Al is present as an Al phase, a ternary eutectic structure [Zn/Al/$MgZn_2$], or the like.

Although the sacrificial corrosion protection function of Al is small, the corrosion resistance is improved when Al is included in the plated layer. In addition, when Al is not present in the plating bath, Mg cannot be stably held in the plating bath. Therefore, Al is added to the plating bath. The Al content is preferably 6.0% or more in the upper plated layer. This is because the content is required for securing the corrosion resistance to some extent. Below the content, the upper plated layer is difficult to secure the corrosion resistance. In addition, when the Al content is 6.0% or more in the upper plated layer, the alloy layer actively grows, and the thickness of the alloy layer can be stably secured. On the other hand, when the Al content is excessive, the lower alloy layer excessively grows in the manufacturing process. Therefore, growth control becomes difficult, and defects such as gray coating, in which the alloy layer reaches the plating surface, are easily generated. Therefore, the Al content is 25.0% or less in the upper plated layer.

Mg: More than 3.0 to 12.5%

Mg is an element that has the sacrificial corrosion protection function and enhances the corrosion resistance of the upper plated layer. When a certain amount or more of Mg is included, an $MgZn_2$ phase is formed in the upper plated layer. As the Mg content is high in the upper plated layer, more $MgZn_2$ phase is formed. The Mg content is more than 3.0%, because the content is required to exhibit the corrosion resistance, and the sufficient corrosion resistance cannot be obtained when Mg is 3.0% or less. On the other hand, when the Mg content is excessive, the upper plated layer is difficult to manufacture. Therefore, the upper limit is 12.5% or less. More preferably, the Mg content may be more than 5.0% and 12.5% or less, may be more than 5.0% and 10.0% or less, or may be more than 5.0% and 8.0% or less.

Ni: 0.001 to Less than 0.5%

Ni is included in the plated-metal-layer to form an Al—Fe—Ni-based alloy. Ni tends to concentrate in the intermediate alloy layer during solidification of the plating bath. Therefore, in the upper plated layer, the Ni content is 0.001 to less than 0.5%. As described above, the Ni content is low in the upper plated layer. Therefore, there is no Al—Fe—Ni-based alloy in the upper plated layer, or even if there is an Al—Fe—Ni-based alloy, the amount thereof is very small.

Si: 0 to 1.5%

Si is an element belonging to metalloid. Si precipitates a Si single phase or $Mg_2Si$ in the upper plated layer. When Ca is further included in the plated layer together with Si, an Al—Ca—Si compound is precipitated. As a result, the corrosion resistance of the upper plated layer is improved. There is an upper limit to the Si content, and when the content exceeds the upper limit, adhesion of dross and the like increases, and the corrosion resistance tends to deteriorate. In addition, when Si is excessively included in the plating bath, formation of the alloy layer to be described later is significantly suppressed. Therefore, the Si content in the upper plated layer has an appropriate range. Therefore, Si is 0% or more and 1.5% or less, and preferably more than 0% and 1.0% or less.

Sn: 0 to 3.0%

Bi: 0 to 1.0%

In: 0 to 1.0%

Sn, Bi, and In have a function of improving the sacrificial corrosion resistance of the upper plated layer. That is, there is an effect of suppressing the occurrence of red rust from the steel material when corrosion locally progresses. However, there is an upper limit to the amount of these elements. When these elements exceed the upper limit, adhesion of dross and the like increases, and the cost does not match the performance improvement. Therefore, Sn is 0 to 3.0%, more preferably more than 0% and less than 3.0%. Bi is 0 to 1.0%, more preferably more than 0% to less than 1.0%. In is 0 to 1.0%, more preferably more than 0% and less than 1.0%.

Ca: 0 to 3.0%

Y: 0 to 0.5%

La: 0 to 0.5%

Ce: 0 to 0.5%

Sr: 0 to 0.5%

Ca, Y, La, Ce, and Sr are easily oxidized in the air. When present in the plating bath, these elements form a dense oxide film on the bath surface, and have an effect of preventing oxidation of Mg. Through the above effect, the Mg content is stabilized, and the upper plated layer having a target composition is easily manufactured. In order to suitably exhibit such an effect, the amount of each of these elements is more than 0%, and more preferably 0.01% or more. In addition, there is an upper limit to the amount of each element. When the content exceeds the upper limit, it tends to be difficult to form a plating bath. In addition, adhesion of dross or the like increases, and weldability tends to deteriorate. Therefore, Ca is 0 to 3.0%. Therefore, the amount of each of Y, La, Ce, and Sr is 0 to 0.5%, preferably more than 0 and less than 0.5%, and more preferably 0.01% or more and less than 0.5%.

B: 0 to 1.0%

P: 0 to 0.5%

B and P are elements belonging to metalloid, and improve the corrosion resistance of the upper plated layer. These elements generally affect the corrosion resistance. However, there is an upper limit to the amount of each element. When the content exceeds the upper limit, adhesion of dross or the like increases, and the corrosion resistance tends to deteriorate. Therefore, B and P are 0 to 1.0% and 0 to 0.5%, respectively.

Cr: 0 to 0.25%

Ti: 0 to 0.25%

Co: 0 to 0.25%

V: 0 to 0.25%

Nb: 0 to 0.25%

Cu: 0 to 1.0%

Mn: 0 to 0.25%

Mo: 0 to 0.25%

W: 0 to 0.25%

Zr: 0 to 0.25%

Ag: 0 to 1.0%

Li: 0 to 0.5%

Na: 0 to 0.05%

K: 0 to 0.05%

Cr, Ti, Co, V, Nb, Cu, Mn, Mo, W, Zr, Ag, Li, Na, and K are metal elements. These elements are included into the upper plated layer to form substitutional solid solution or new intermetallic compound having a high melting point. This improves the corrosion resistance. There is an upper limit to the amount of each element. When the content exceeds the upper limit, adhesion of dross or the like tends to increase. Therefore, the amount of each of Na and K is 0 to 0.05%, and preferably more than 0% and less than 0.05%. The amount of each of Cr, Ti, Co, V, Nb, Mn, Mo, W, and Zr is 0 to 0.25%, and preferably more than 0% and less than 0.25%. The amount of Li is 0% to 0.5% or less, and preferably more than 0% and less than 0.5%. Cu and Ag are each 0 to 1.0%, and preferably more than 0% and less than 1.0%.

Ba: 0 to 0.25%

Ba is an element having properties similar to those of Zn. Therefore, when Ba is included, a special effect is hardly exhibited, but there is an effect that a spangle pattern is easily formed on the appearance of the plating, and the like. However, when Ba is excessively included, the corrosion resistance of the upper plated layer may be deteriorated. Accordingly, the amount of Ba is 0 to 0.25%, and preferably more than 0% and less than 0.25%.

Fe: 0 to 5.0%

In addition, Fe may be inevitably included in the upper plated layer. This is because Fe may be diffused from the base metal into the upper plated layer during plating. It has been confirmed that when Fe is 5.0% or less, the corrosion resistance of the upper plated layer is not adversely affected. Therefore, the Fe content is 0% to 5.0% or less, and may be more than 0% and less than 5.0%.

Balance: Zn and Impurities

Zn is a metal having a low melting point, and when the upper plated layer is the Zn—Al—Mg-based alloy, Zn is present as a Zn phase, a $Mg_2Zn$ phase, a ternary eutectic structure [$Zn/Al/MgZn_2$], a $Mg_2Zn_{11}$ phase, or the like. Zn is an element necessary for securing the corrosion resistance of the upper plated layer, and for obtaining a sacrificial corrosion protection function for the steel material. Zn is included in the balance, but the content is preferably 50.00% or more, and more preferably more than 50.00%. When Zn is less than 50.00% or is 50.00% or less, the sacrificial corrosion resistance of the plated layer is deteriorated. That is, when corrosion locally progresses, it is difficult to suppress red rust generation from the steel material. The Zn content is more preferably 65.00% or more, or 70.00% or more. Note that the upper limit of the Zn content is the amount of the balance other than elements excluding Zn and impurities.

The impurities in the upper plated layer refer to a component which is included in a raw material or a component which is mixed in the manufacturing process. For instance, in the plated layer, a small amount of component other than Fe may be mixed as the impurity due to mutual atomic diffusion between the steel material (base metal) and the plating bath.

In the plated steel material according to the embodiment, the upper plated layer preferably satisfies a following formula (1) and a following formula (2).

$$Mg/Al \leq 0.5 \quad (1)$$

$$2 \times Ca + Sr + Y + La + Ce \geq 0.05 \quad (2)$$

Herein, in the formula (1) and the formula (2), each of Mg, Al, Ca, Sr, Y, La, and Ce is a content (mass %) in the upper plated layer, and substituted with 0 when the element is not included in the upper plated layer.

Mg has an effect of suppressing the Al—Fe alloying reaction. When the formula (1) is satisfied, the thickness of the upper plated layer can be secured.

In addition, Ca, Cr, Y, La, and Ce are easily oxidized in the air. When present in the plating bath, these elements form a dense oxide film on the bath surface, and have an effect of preventing oxidation of Mg. When the amount of each of these elements satisfies the formula (2), the Mg content in the upper plated layer is stabilized, and the upper plated layer having a target composition can be formed.

In order to identify the average chemical composition of the upper plated layer, the chemical composition can be determined by ICP emission spectrometry or ICP-MS. Specifically, the upper plated layer is peeled off and dissolved with acid containing an inhibitor which suppresses corrosion of the alloy layer (intermediate alloy layer and lower alloy layer) or alkali solution, thereby obtaining solution. More specifically, for peeling and dissolving with acid, acid solution in which IBIT No. 700AS, a commercially available inhibitor, is added in 0.01 mass % to 10 mass % hydrochloric acid aqueous solution can be used. For peeling with alkaline solution, 5 mass % NaOH aqueous solution can be used. Next, when the obtained solution is acid solution, the acid solution is measured by emission spectrometry or ICP-MS. When the obtained solution is alkali solution, acid treatment is performed, and then the solution is measured by emission spectrometry or ICP-MS.

The thickness of the upper plated layer can be determined by subtracting the thickness of the alloy layer described later from the thickness of the plated-metal-layer. The thickness of the plated-metal-layer is derived by cross-sectional microstructure observation. Specifically, a cross section perpendicular to the surface of the plated steel material is exposed. The exposed cross section is mirror-finished. In a SEM reflected electron image of the cross section of the plated-metal-layer appearing in the cross section, the distance in the thickness direction between the outermost surface of the plated-metal-layer (the surface of the plated steel material) and the surface of the steel material is measured at 10 points, and the average value thereof is calculated as the thickness of the plated-metal-layer. The distance between the measurement points is preferably about 100 μm. Then, from the thickness of the plated-metal-layer, the thickness of the alloy layer described later is subtracted. Thus, the thickness of the upper plated layer can be derived.

It is preferable that the upper plated layer includes no quasicrystal phase. When the steel material is dipped in a plating bath containing 8% or more of Mg among plating baths containing Zn, Al, and Mg, and cooled under high cooling rate immediately after pulling up, a quasicrystal phase having a composition of $Mg_{32}$ $(Zn, Al)_{49}$ may appear in the microstructure of the plated layer. The quasicrystal phase has a brittle microstructure. Therefore, in the embodiment, when the upper plated layer includes the quasicrystal phase, a crack may occur in the upper plated layer to adversely affect the corrosion resistance thereof. Therefore, from the viewpoint of further improving the corrosion resistance, the area fraction of the quasicrystal phase is preferably 0.5% or less when the quasicrystal phase is included in the upper plated layer. The area fraction of the quasicrystal phase may be 0%.

The area fraction of the quasicrystal phase can be determined by cross-sectional microstructure observation. First, a cross section perpendicular to the surface of the plated steel material is exposed. The exposed cross section is mirror-finished. In the exposed cross section, the measurement region of the upper plated layer is specified. For the measurement region of the upper plated layer, when the thickness of the upper plated layer is 20 μm, the range in the longitudinal direction of the measurement region is from the surface of the plated steel material to the position at a depth of 16 μm. In the upper plated layer, the range in the lateral direction of the measurement region is a range of 40 μm in parallel to the surface of the plated steel material. The measurement region is set at five positions.

Next, element mapping is performed for Mg in the measurement region in the upper plated layer using an electron beam probe microanalyzer (EPMA). Based on the result, the region where the Mg content is 19 mass % or more is specified as the quasicrystal phase, and the area fraction of the quasicrystal phase is determined for each of the five measurement regions. Then, the average value of the area fraction of the quasicrystal phase of the five measurement regions is determined as the area fraction of the quasicrystal.

The EPMA measurement conditions are as follows: measurement is performed using electronic probe microanalyzer JXA-8230, which is manufactured by JEOL Ltd., with an electron beam output of 15 kV and 50 nA and an irradiation time of 50 milliseconds.

The quasicrystal phase is a phase including a quasicrystal. The quasicrystal is the crystal structure which was firstly discovered in 1982 by Dr. Daniel Shechtman, and has an atomic arrangement with a polyhedron with 20 faces (icosahedron). The quasicrystal is known as the crystal structure which has unique rotational symmetry not to be obtained by general metals and alloys, is a non-periodic crystal structure having fivefold symmetry for instance, and is equivalent to a non-periodic structure such as a three-dimensional Penrose Pattern. The metal material is identified by, for instance, performing electron beam observation through TEM observation to obtain from the phase a radial electron beam diffraction pattern with regular decagon due to the structure of polyhedron with 20 faces.

The quasicrystal phase that may be formed by the composition of the plating bath in the embodiment shows diffraction peaks which can be simply identified as a $Mg_{32}$ (Zn, Al) 49 phase by X-ray diffraction using JCPDS cards: PDF #00-019-0029 or #00-039-0951. The diffraction peaks are often observed around 36.3 to 8°. However, in the embodiment, the region where the Mg content is 19 mass % or more may be specified as the quasicrystal phase.

Next, the alloy layer (lower alloy layer and intermediate alloy layer) will be described.

Although the thickness and form of the alloy layer vary depending on the steel type of the steel material and the manufacturing conditions of the plated-metal-layer, the alloy layer is formed as a layer mainly made of an Al—Fe-based alloy or an alloy in which the Al—Fe-based alloy includes a substitution element or a solid solution element such as Ni or Si. The form of the alloy layer can be roughly divided into two forms.

Specifically, when observing cross-sectional microstructure, the above two forms may be: a homogeneous structure in which the Al—Fe-based alloy is formed as a homogeneous layer; and a mixed phase structure in which the Al—Fe-based alloy is formed in an island-like shape or mesh-like shape and the Zn-based alloy formed by solidifying the plating bath almost without any change is present between the alloys.

Compared the one-stage plating method as in the embodiment with the two-stage plating method in order to form the alloy layer, the formed alloy layer has different microstructures, from which the manufacturing method of the product can be determined in some cases. This is due to the formation behavior of the alloy layer. In the one-stage plating method, the alloy layer is formed by the reaction between the steel material and the plating bath in a plating bath containing Al, and is formed as a homogeneous layer including the Al—Fe-based alloy. On the other hand, in the two-stage plating method, when a plated material in which a Fe—Zn-based alloy layer has been already formed on a steel material is dipped in a plating bath containing Al, a phenomenon occurs in which the Fe—Zn-based alloy layer changes into an Al—Fe-based alloy layer. Since the change from the Fe—Zn-based alloy to the Al—Fe-based alloy is accompanied by volume shrinkage, an island-like or mesh-like Al—Fe-based alloy is formed.

The difference in the form of the Al—Fe-based alloy appears as the difference in the average composition of the alloy layer. That is, when the cross-sectional microstructure is subjected to an element mapping analysis through EPMA to measure the composition of the alloy layer, a homogeneous structure shows, as the composition, an analysis value close to an Al—Fe-based alloy composition analyzed by point analysis. On the other hand, when a mixed phase structure is subjected to area analysis, a result is obtained in which the Zn content is high and the Fe content is low, as compared with a homogeneous structure, because a Zn-based alloy is contained.

Hereinafter, the lower alloy layer will be described.

The lower alloy layer is formed on the surface of the steel material. Therefore, the region mainly including the Al—Fe-based alloy on the surface of the steel material can be defined as the lower alloy layer.

Although the thickness and form of the lower alloy layer containing the Al—Fe-based alloy vary depending on the steel type of the steel material and the manufacturing conditions of the plated-metal-layer, the lower alloy layer is formed as a homogeneous layer including the Al—Fe-based alloy when manufactured by the one-stage plating method as in the embodiment.

The lower alloy layer is formed on the surface of the steel material, and includes an $Al_5Fe_2$ phase as a main phase as a microstructure. In the lower alloy layer, microstructures made of the Al—Fe-based alloy may occupy the largest area fraction or the largest volume fraction. The Al—Fe-based alloy is formed by mutual atomic diffusion between the base metal (steel material) and the plating bath. However, in the case of using the hot-dip plating method as a manufacturing method, when a steel material is dipped in a plating bath containing Al, an Al—Fe-based alloy is easily formed. However, when a certain amount or more of Al is contained in a plating bath, an $Al_5Fe_2$ phase is formed most. However, the atomic diffusion takes time, and there is a portion where the Fe content is high in a portion close to the base metal. Therefore, an AlFe phase, an $Al_3Fe$ phase, an $Al_5Fe$ phase, or the like may be partially contained in the Al—Fe-based alloy included in the lower alloy layer. In addition, the plating bath contains a certain amount of Zn. Therefore, in the Al—Fe-based alloy constituting the lower alloy layer, Zn makes solid solution or a part of Al is substituted with Zn. Therefore, the lower alloy layer also includes Zn.

In addition, when Si is included in the plated-metal-layer, Si is easily included into the Al—Fe-based alloy constituting the lower alloy layer, so that Si may become an Al—Fe—Si intermetallic compound in the lower alloy layer. Specifically, the intermetallic compound includes an AlFeSi phase, and the isomer thereof includes α, β, q1, q2-AlFeSi phases. Therefore, these AlFeSi phases and the like may be detected in the Al—Fe-based alloy.

The lower alloy layer includes, as a chemical composition, 5.0 to 30.0% of Zn, 30.0 to 55.0% of Al, 22.5 to 50.0% of Fe, 0 to 10.0% of Si, 0 to less than 0.5% of Ni, 0 to 1.0% of Mg, and a balance including impurities.

In the lower alloy layer, Zn is included in the Al—Fe-based alloy. An Al—Fe-based alloy containing no Zn forms red rust when corroded, but the Al—Fe-based alloy containing Zn does not form red rust and becomes yellow rust or black rust. In order not to form red rust, the lower alloy layer is required to include 5.0% or more of Zn. On the other hand, the upper limit of the amount of Zn included in the Al—Fe-based alloy is about 30.0%. When the Al—Fe-based alloy has a homogeneous structure, it is difficult to include more. Therefore, in the lower alloy layer, the Zn content is preferably 30.0% or less. Therefore, Zn is included in the lower alloy layer in a range of 5.0 to 30.0%.

In the lower alloy layer, Al is a main element constituting the Al—Fe-based alloy. The lower limit and the upper limit of the Al content are determined by the phase constituent of the Al—Fe-based alloy to be formed. In the embodiment, Al is preferably included in a ratio of 30.0 to 55.0% in the lower alloy layer.

In the lower alloy layer, Fe is a main element constituting the Al—Fe-based alloy. The lower limit and the upper limit of the Fe content are determined by the phase constituent of the Al—Fe-based alloy to be formed. In the embodiment, Fe is preferably included in a ratio of 22.5 to 50.0% in the lower alloy layer.

When contained in the plating bath, Si has an effect of suppressing the alloying reaction between Al and Fe. Therefore, Si may be added in the plating bath to control alloying of Al and Fe. However, when the Si content is about more than 1.5% in the plating bath, the lower alloy layer hardly grows at a bath temperature of 540° C. or lower, and the barrier property by the Al—Fe-based alloy cannot be secured, and the corrosion resistance is deteriorated. In addition, Si tends to be concentrated in an Al—Fe-based alloy or an Al—Fe—Ni-based alloy, and the Si content may be higher in the lower alloy layer than in the upper plated layer. Nevertheless, when the Si content is 1.5% or less in the plating bath, Si does not exceed 10.0% in the lower alloy layer. Therefore, the upper limit of Si is 10.0% or less in the lower alloy layer. When Si is not contained in the plating bath, Si is 0% in the lower alloy layer. Therefore, the amount of Si is 0 to 10.0% in the lower alloy layer.

When the plated steel material is manufactured by the two-stage plating method using a plating bath containing Si, a mixed phase structure in which an Al—Fe-based alloy and a Zn-based alloy formed by solidifying the plating bath almost without any change are solidified may be obtained. However, in such a mixed phase structure, corrosion proceeds along the Zn-based alloy formed by solidifying the plating bath almost without any change, so that the corrosion resistance of the Al—Fe-based alloy cannot be utilized and the corrosion resistance of the plated-metal-layer itself is lowered.

Ni is included in the plated-metal-layer to form an Al—Fe—Ni-based alloy. Ni tends to concentrate in the intermediate alloy layer during solidification of the plating bath. Therefore, the Ni content is 0 to less than 0.5% in the lower alloy layer. As described above, the Ni content is low in the lower alloy layer. Therefore, there is no Al—Fe—Ni-based alloy in the lower alloy layer, or even if there is an Al—Fe—Ni-based alloy, the amount thereof is very small.

The lower alloy layer may include Mg. Mg has small solid solubility in the Al—Fe-based alloy. Therefore, when the Al—Fe-based alloy does not form a mixed phase structure together with the solidified microstructure derived from the plating bath, the content thereof is 1.0% or less. Therefore, the amount of Mg is in a range of 0 to 1.0%.

The balance in the lower alloy layer is impurities. Similarly to the upper plated layer, the impurities in the lower alloy layer refer to a component which is included in a raw material or a component which is mixed in the manufacturing process. For instance, in the lower alloy layer, a small amount of component other than Fe may be mixed as the impurity due to mutual atomic diffusion between the steel material (base metal) and the plating bath.

The lower alloy layer may include 0 to 2.0% in total of at least one element selected from a group consisting of Ca, Sn, Bi, In, Y, La, Ce, Sr, B, P, Cr, Ti, Co, V, Nb, Cu, Mn, Mo, W, Zr, Ag, Li, Na, K, and Ba. Although these elements are elements constituting the upper plated layer, a small amount of these elements may be mixed into the lower alloy layer.

The average chemical composition of the lower alloy layer can be identified by analyzing the cross section of the lower alloy layer with an electron beam probe microanalyzer (EPMA) and quantitatively analyzing the elements included in the region of the lower alloy layer. Details will be described later.

The lower alloy layer is required to have a certain thickness from the viewpoint of the corrosion resistance. In order to secure sufficient corrosion resistance, the thickness is preferably 5 μm or more, more preferably 30 μm or more, and further preferably 50 μm or more. The method for measuring the thickness will be described later.

Next, the intermediate alloy layer will be described. The intermediate alloy layer is arranged between the lower alloy layer and the upper plated layer. That is, the intermediate alloy layer is formed closer to the upper plated layer than the lower alloy layer. The intermediate alloy layer includes an Al—Fe—Ni-based alloy. The Al—Fe—Ni-based alloy is an Al—Fe-based alloy including Ni. The Al—Fe—Ni-based alloy is formed by manufacturing the plated-metal-layer using a plating bath to which Ni is added.

When the plated steel material is manufactured by the two-stage plating method using a plating bath containing Ni, a mixed phase structure in which an Al—Fe—Ni-based alloy and a Zn-based alloy formed by solidifying the plating bath almost without any change are solidified may be obtained. However, in such a mixed phase structure, corrosion proceeds along the Zn-based alloy, so that the corrosion resistance of the Al—Fe—Ni-based alloy cannot be utilized and the corrosion resistance of the plated-metal-layer itself may be undesirably lowered.

The intermediate alloy layer may be entirely constituted by a microstructure made of the Al—Fe—Ni-based alloy. Alternatively, the intermediate alloy layer may include a microstructure other than the Al—Fe—Ni-based alloy. In this case, the microstructure made of the Al—Fe—Ni-based alloy preferably occupies the largest area fraction or the largest volume fraction.

The intermediate alloy layer is common to the lower alloy layer in that Al and Fe are included, but can be distinguished from the lower alloy layer in whether Ni is included in an amount of 0.5% or more. Specifically, the intermediate alloy layer can be distinguished by EPMA mapping of a region where Fe, Al, and Ni are present. The Al—Fe—Ni-based alloy, which includes Ni, has higher corrosion resistance than the Al—Fe-based alloy, which constitutes the lower alloy layer. When the intermediate alloy layer including such an Al—Fe—Ni-based alloy is distributed substantially parallel to the surface of the steel material and is present so as to cover the lower alloy layer, a high barrier effect can be obtained. In addition, the Al—Fe—Ni-based alloy has poor wettability with a flux residue. Therefore, when the Al—Fe—Ni-based alloy is formed, the flux residue is quickly separated from the surface of the steel material and floats on the plating bath surface. That is, the separability of a flux is improved. As a result, defects such as a decrease in the corrosion resistance due to bare spots and a flux residue are suppressed.

The Al—Fe—Ni-based alloy is constituted by an $Al_3Fe$ phase or an $Al_5Fe_2$ phase each containing Ni. However, the Al—Fe—Ni-based alloy may partially include an AlFe phase, an $Al_3Fe$ phase, an AlsFe phase, or the like. In addition, since a certain amount of Zn is also contained in the plating bath, Zn is also included in the Al—Fe—Ni-based alloy. Zn can be present in a form of substitution or solid solution with Al, or both. Further, when Si is included in the plated-metal-layer, an Al—Fe—Ni—Si intermetallic compound may be formed. The intermetallic compound to be identified here includes an AlFeSi phase, and the isomer thereof includes α, β, q1, q2-AlFeSi phases. Therefore, these AlFeSi phases and the like may be detected in the Al—Fe—Ni-based alloy.

The Al—Fe—Ni-based alloy included in the intermediate alloy layer preferably includes, as a composition, 5.0 to 30.0% of Zn, 30 to 60% of Al, 30 to 50% of Fe, 0 to 10% of Si, 0.5 to 10% of Ni, 0 to 1.0% of Mg, and a balance including impurities.

The intermediate alloy layer includes, as a chemical composition, 5.0 to 35.0% of Zn, 25.0 to 60.0% of Al, 20.0 to 45.0% of Fe, 0 to 10.0% of Si, 0.5 to 10.0% of Ni, 0 to 1.0% of Mg, and a balance including impurities.

In the intermediate alloy layer, Zn is mainly included in the Al—Fe—Ni-based alloy. An Al—Fe—Ni-based alloy containing no Zn forms red rust when corroded, but the Al—Fe—Ni-based alloy containing Zn does not form red rust and becomes yellow rust or black rust. In order to suppress red rust generation, the intermediate alloy layer is required to include 5.0% or more of Zn.

On the other hand, the upper limit of the amount of Zn included in the Al—Fe—Ni-based alloy is about 30.0%. When the Al—Fe—Ni-based alloy has a homogeneous structure, the solidified phase of the plating bath does not largely occupy the intermediate alloy layer. Therefore, Zn is 35.0% or less in the intermediate alloy layer.

In the intermediate alloy layer, Al is a main element constituting the Al—Fe—Ni-based alloy. The lower limit and the upper limit of the Al content are determined based on the phase constituent of the formed Al—Fe-based alloy. In the embodiment, Al is preferably included in the intermediate alloy layer in a ratio of 25.0 to 60.0%.

In the intermediate alloy layer, Fe is a main element constituting the Al—Fe—Ni-based alloy. The lower limit and the upper limit of the Fe content are determined based on the phase constituent of the formed Al—Fe—Ni-based alloy. In the embodiment, Fe is preferably included in the intermediate alloy layer in a ratio of 20.0 to 45.0%.

Similarly to Si in the Al—Fe-based alloy in the lower alloy layer, in the intermediate alloy layer, Si tends to be concentrated in the Al—Fe—Ni-based alloy. Therefore, Si may be included in a higher content in the intermediate alloy layer than in the upper plated layer. When the upper limit of the Si content in the plating bath is 1.5%, the Si content does not exceed 10.0% in the intermediate alloy layer. Therefore, the upper limit of Si is 10.0%. When Si is not contained in the plating bath, Si is 0% in the intermediate alloy layer. Therefore, the amount of Si is 0 to 10.0% in the intermediate alloy layer.

Since Ni is concentrated in the intermediate alloy layer when the plated-metal-layer is solidified, the Ni content in the intermediate alloy layer is higher than the Ni content in the lower alloy layer and the Ni content in the upper plated layer. When the upper plated layer includes 0.5% or more of Ni, the corrosion resistance of the upper plated layer is deteriorated. Therefore, the plating bath is required to contain less than 3.0% of Ni. In that case, since it is difficult that the Ni content is more than 10% in the intermediate alloy layer, the Ni content is 10.0% or less in the intermediate alloy layer. In addition, when 0.5% or more of Ni is included in the intermediate alloy layer, the Al—Fe—Ni-based alloy is sufficiently formed. Therefore, the amount of Ni is 0.5% or more.

The intermediate alloy layer may include Mg. Mg has a small solid solubility in the Al—Fe—Ni-based alloy. Therefore, the content thereof is 1.0% or less. Therefore, the amount of Mg is in a range of 0 to 1.0%.

The intermediate alloy layer may include 0 to 2.0% in total of at least one element selected from a group consisting of Ca, Sn, Bi, In, Y, La, Ce, Sr, B, P, Cr, Ti, Co, V, Nb, Cu, Mn, Mo, W, Zr, Ag, Li, Na, K, and Ba. Although these elements are elements constituting the upper plated layer, a small amount of these elements may be mixed into the intermediate alloy layer.

The balance in the intermediate alloy layer is impurities. Similarly to the upper plated layer or the lower alloy layer, the impurities in the intermediate alloy layer refer to a component which is included in a raw material or a component which is mixed in the manufacturing process. For instance, in the intermediate alloy layer, a small amount of component other than Fe may be mixed as the impurity due to mutual atomic diffusion between the steel material (base metal) and the plating bath.

The intermediate alloy layer preferably has a thickness of 1.0 μm or more. On the other hand, since it is difficult that the intermediate alloy layer has a thickness of more than 40 μm, the thickness of the intermediate alloy layer is 1.0 μm or more and 40 μm or less.

The total thickness of the plated-metal-layer is preferably 25 to 200 μm. In general, the thickness of the plated-metal-layer, such as a plating film, has a correlation with the corrosion resistance. As the thickness becomes larger, the corrosion resistance is more excellent, and the defect resistance is enhanced. On the other hand, the thickness of the plating film has limitation due to lifting of the plating bath, and a large amount of plated metal is required to thicken the plating film, which leads to an increase in cost. Therefore, in the embodiment, the thickness of the plated-metal-layer is preferably 200 μm or less. When the thickness of the plated-metal-layer is less than 25 μm, the corrosion resistance is reduced, and therefore the thickness of the plated-metal-layer is preferably 25 μm or more.

Hereinafter, various measurement methods will be described.

The thickness of the alloy layer (the total thickness of the lower alloy layer and the intermediate alloy layer) is determined by determining the boundary between the upper plated layer and the alloy layer in a SEM reflected electron image of the cross section of the plated-metal-layer. When the boundary between the upper plated layer and the alloy layer is determined, attention is paid to the Al—Fe—Ni-based alloy and the Al—Fe-based alloy included in the alloy layer.

Figure 1B:
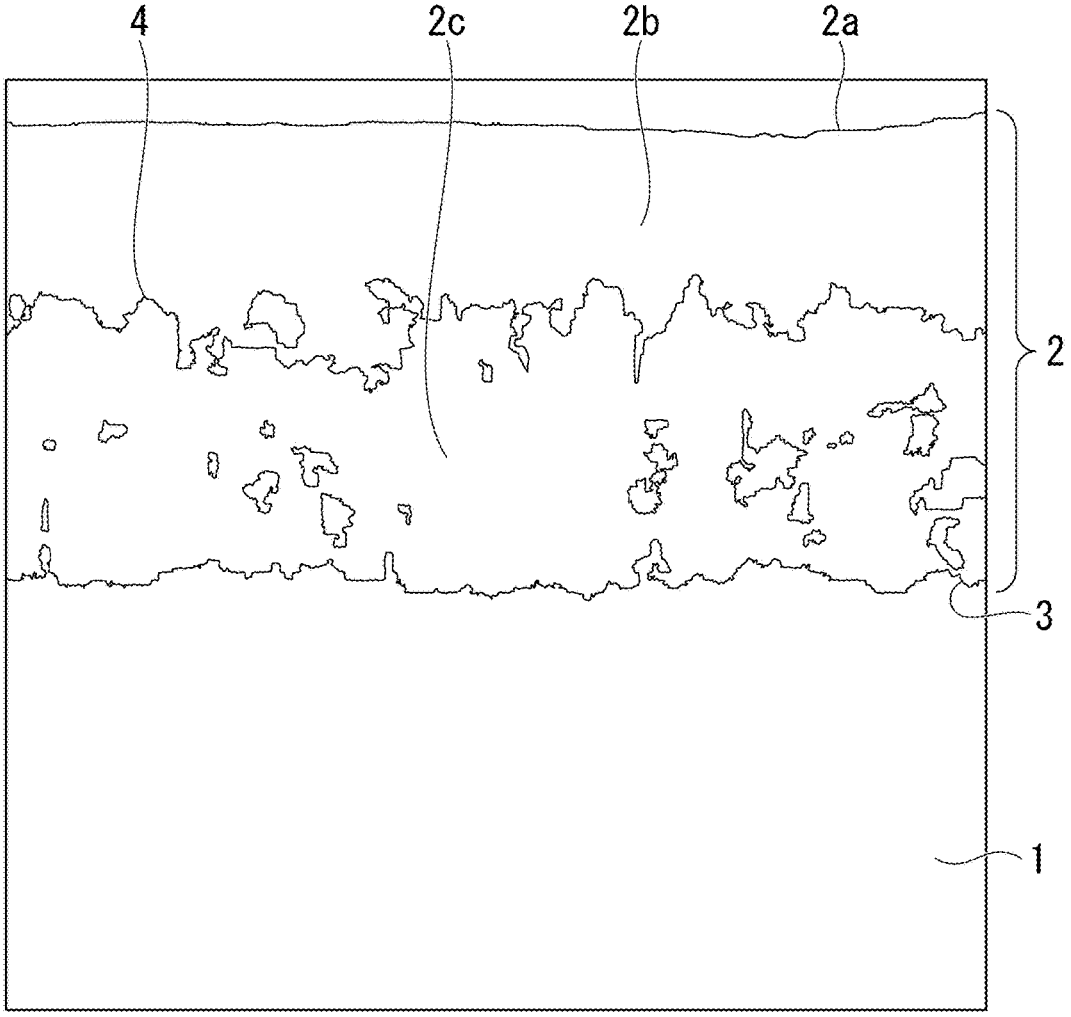
FIG. 1B is an illustration explaining the method for measuring the total thickness of the intermediate alloy layer and the lower alloy layer, and is a schematic illustration showing the cross section of the plated-metal-layer.

First, a cross section perpendicular to the surface of the plated steel material is exposed. The exposed cross section is mirror-finished. FIG. 1A shows an SEM image of a cross section perpendicular to the surface of the plated steel material. The magnification of the SEM image is 1000 times. FIG. 1A is a reflected electron image of SEM. FIG. 1B is a schematic illustration of FIG. 1A. In FIG. 1B, reference numeral 1 denotes a steel material, reference numeral 2 denotes a plated-metal-layer, reference numeral 2*a* denotes the surface of the plated steel material (the surface of the plated-metal-layer), reference numeral 2*b* denotes an upper plated layer, reference numeral 2*c* denotes an alloy layer (an intermediate alloy layer and a lower alloy layer), and reference numeral 3 denotes the cross section profile of the interface between the steel material 1 and the plated-metal-layer 2. In addition, the curve denoted by reference numeral 4 is the boundary between the dark gray region and the white or light gray region in the SEM micrograph, and is a line which is estimated as the boundary line between the upper plated layer 2*b* and the alloy layer 2*c*.

Next, in FIG. 1B, the cross section profile 3 of the interface between the steel material 1 and the plated-metal-layer 2 is specified. In the embodiment, the interface between the steel material 1 and the plated-metal-layer 2 is an uneven surface. Therefore, the cross section profile 3 thereof is a continuous irregular curve.

Figure 1C:
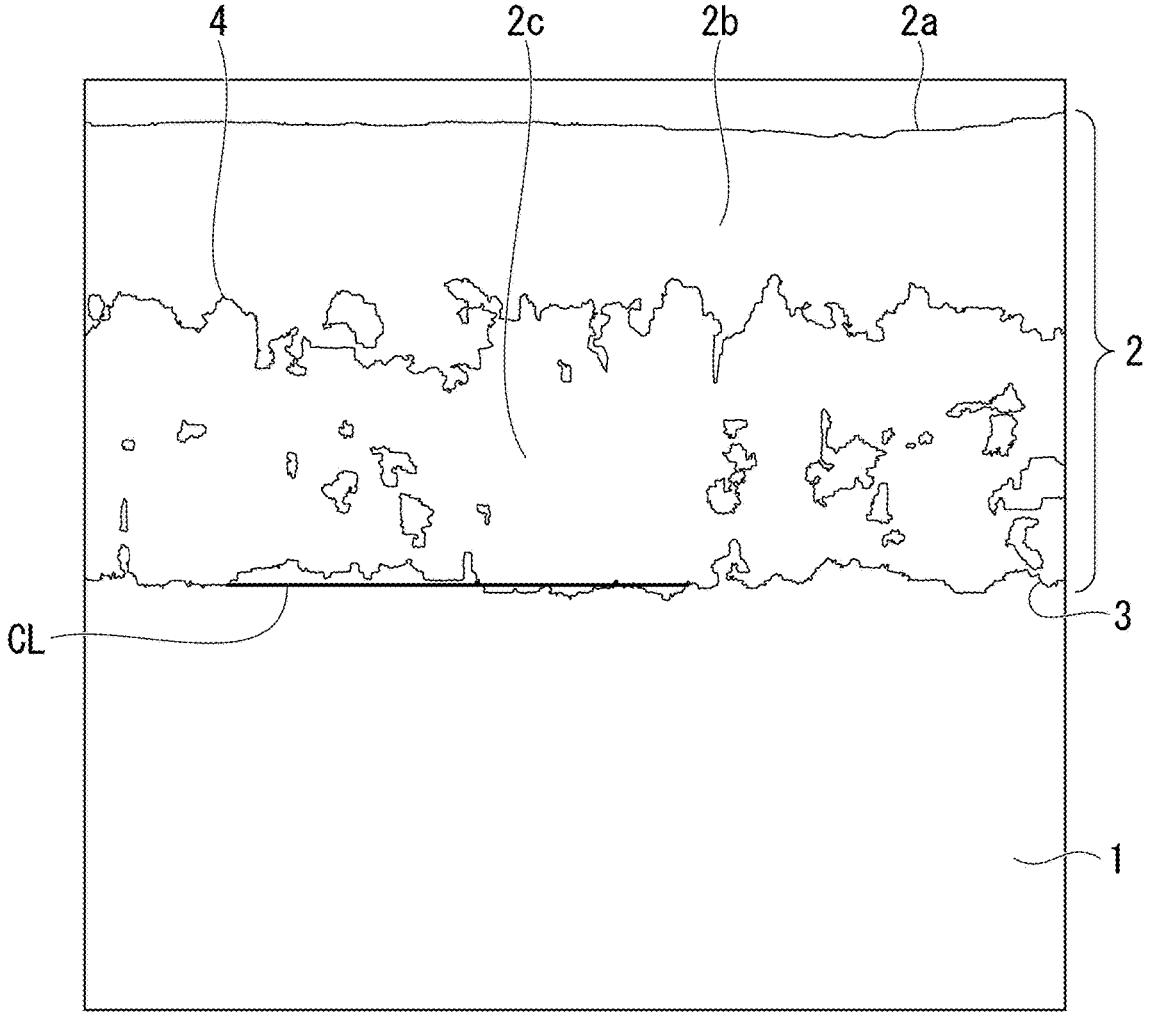
FIG. 1C is an illustration explaining a method for measuring the total thickness of the intermediate alloy layer and the lower alloy layer, and is a schematic illustration showing the cross section of the plated-metal-layer.

Next, as illustrated in FIG. 1C, the center line CL of the cross section profile 3 of the interface is specified. Specifically, the cross section profile 3 of the interface is defined as a roughness curve which is a line roughness curve expressed with a cut-off value=0.8 mm. Then, a straight line CL having a length of 40 μm and substantially parallel to the roughness curve (cross section profile 3) is superimposed on the roughness curve (cross section profile 3). When the roughness curve (cross section profile 3) is overlapped with the straight line CL, there are many intersection points between the cross section profile 3 and the straight line CL, and there is a plurality of regions surrounded by the cross section profile 3 and the straight line CL. The plurality of regions is located on the upper side of the straight line CL (opposite side to the steel material side) and the lower side of the straight line CL (steel material side). Then, the straight line CL is positioned so that the total area of the region located on the upper side of the straight line CL is equal to the total area of the region located on the lower side of the straight line CL. The positioned straight line CL is defined as the center line of the roughness curve of the interface.

Figure 1D:
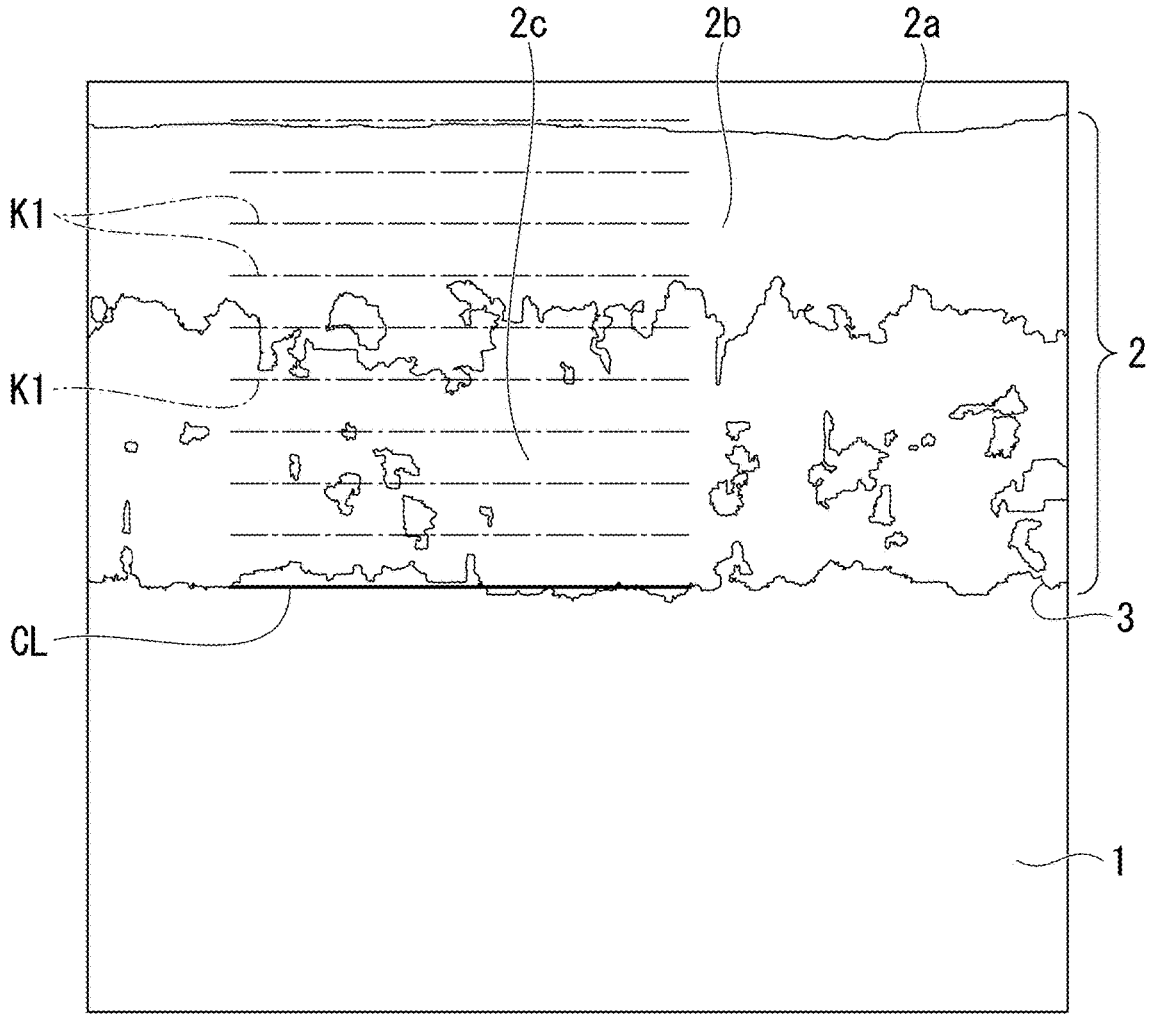
FIG. 1D is an illustration explaining a method for measuring the total thickness of the intermediate alloy layer and the lower alloy layer, and is a schematic illustration showing the cross section of the plated-metal-layer.

Next, as illustrated in FIG. 1D, a plurality of first imaginary lines K1 having a length of 40 μm and parallel to the center line CL of the roughness curve of the interface is set. The plurality of first imaginary lines K1 is set at intervals of 10 μm in the thickness direction of the plated-metal-layer.

Next, for each of the first imaginary lines K1, the length of the part where the Al—Fe—Ni-based alloy or the Al—Fe-based alloy (hereinafter, collectively referred to as measured alloy) overlaps with the first imaginary line K1 is measured. Further, for each of the first imaginary lines K1, the ratio (%) of the length of the part overlapping the measured alloy to the total length of the first imaginary line K1 (40 μm) is determined.

The ratio (%) of the length of the part overlapping the measured alloy to the total length of the first imaginary line K1 is derived by obtaining the luminance distribution on the first imaginary line K1 in the SEM reflected electron image. The phase made of the Al—Fe—Ni-based alloy or the Al—Fe-based alloy is darker than the Zn phase or the steel material and appears brighter than the Al phase or the Mg phase, and thus can be easily distinguished from these phases. The proportion of the luminance corresponding to the measured alloy on the first imaginary line K1 is calculated using image processing software, and the proportion is defined as the ratio of the length of the part overlapping with the first imaginary line K1. Examples of the image software that can be used include ImageJ, which is image processing software in the public domain. The image obtained through SEM observation at a magnification of 1000 times or more is used as image data. The image data is measured using the measurement function of ImageJ for the ratio (%) of the length of the part overlapping the measured alloy to the total length of the first imaginary line K1. The image processing software is not limited to ImageJ, and any software having functions similar to that of ImageJ may be used.

The measured alloy refers to the Al—Fe—Ni-based alloy included in the intermediate alloy layer and the Al—Fe-based alloy included in the lower alloy layer. These alloys may include Zn, Si, Ni, and the like as described in the description of the intermediate alloy layer and the lower alloy layer.

Figure 1E:
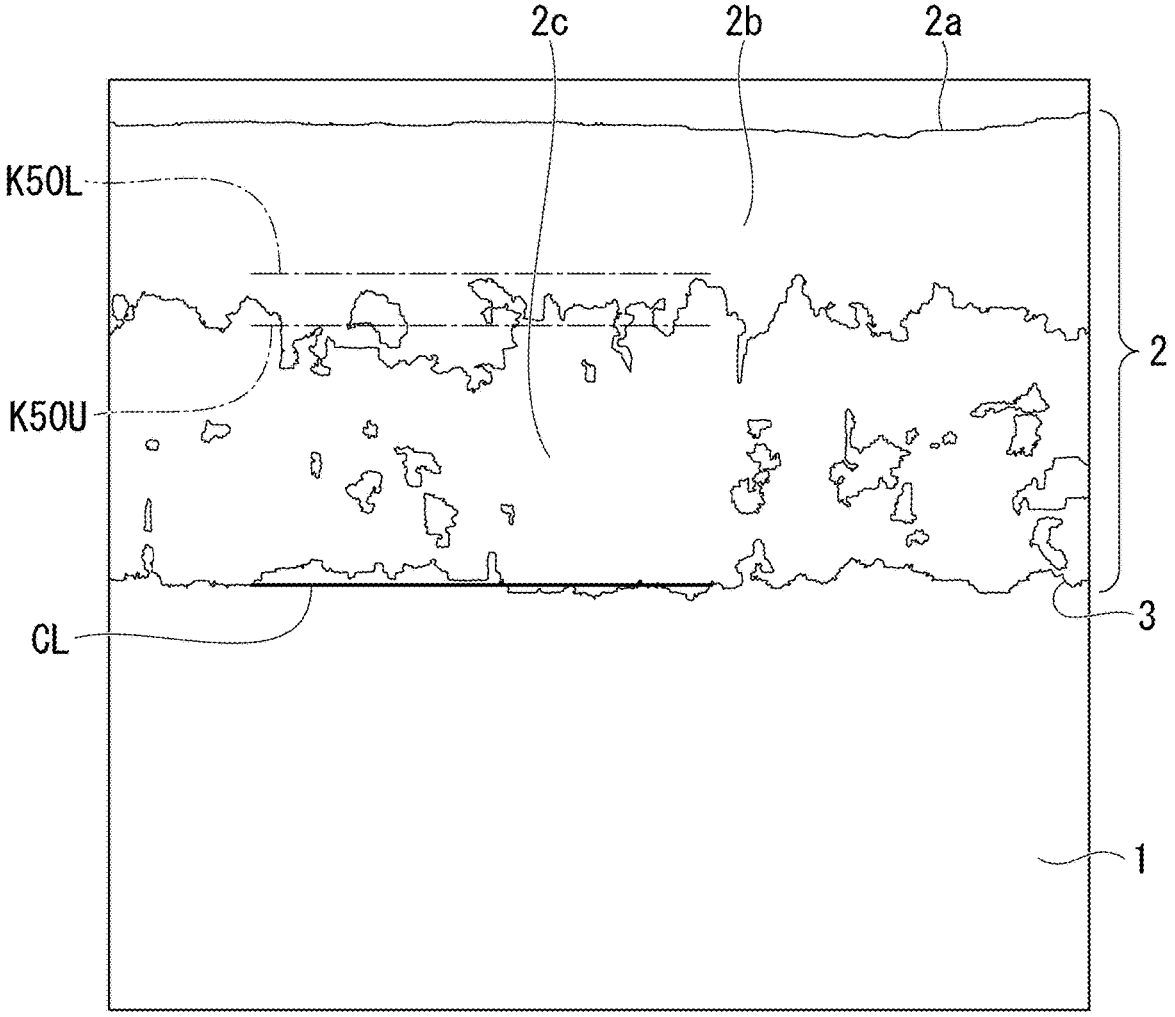
FIG. 1E is an illustration explaining a method for measuring the total thickness of the intermediate alloy layer and the lower alloy layer, and is a schematic illustration showing the cross section of the plated-metal-layer.

Next, as illustrated in FIG. 1E, among the plurality of first imaginary lines K1, the imaginary lines K50L in which the ratio of the part overlapping with the measured alloy is less than 50% and the imaginary lines K50U in which the ratio of the part overlapping with the measured alloy is 50% or more are specified. When there is a plurality of imaginary lines K50L in which the ratio is less than 50%, the imaginary line located closest to the steel material side is specified. These imaginary lines K50L and K50U are used as reference lines.

Figure 1F:
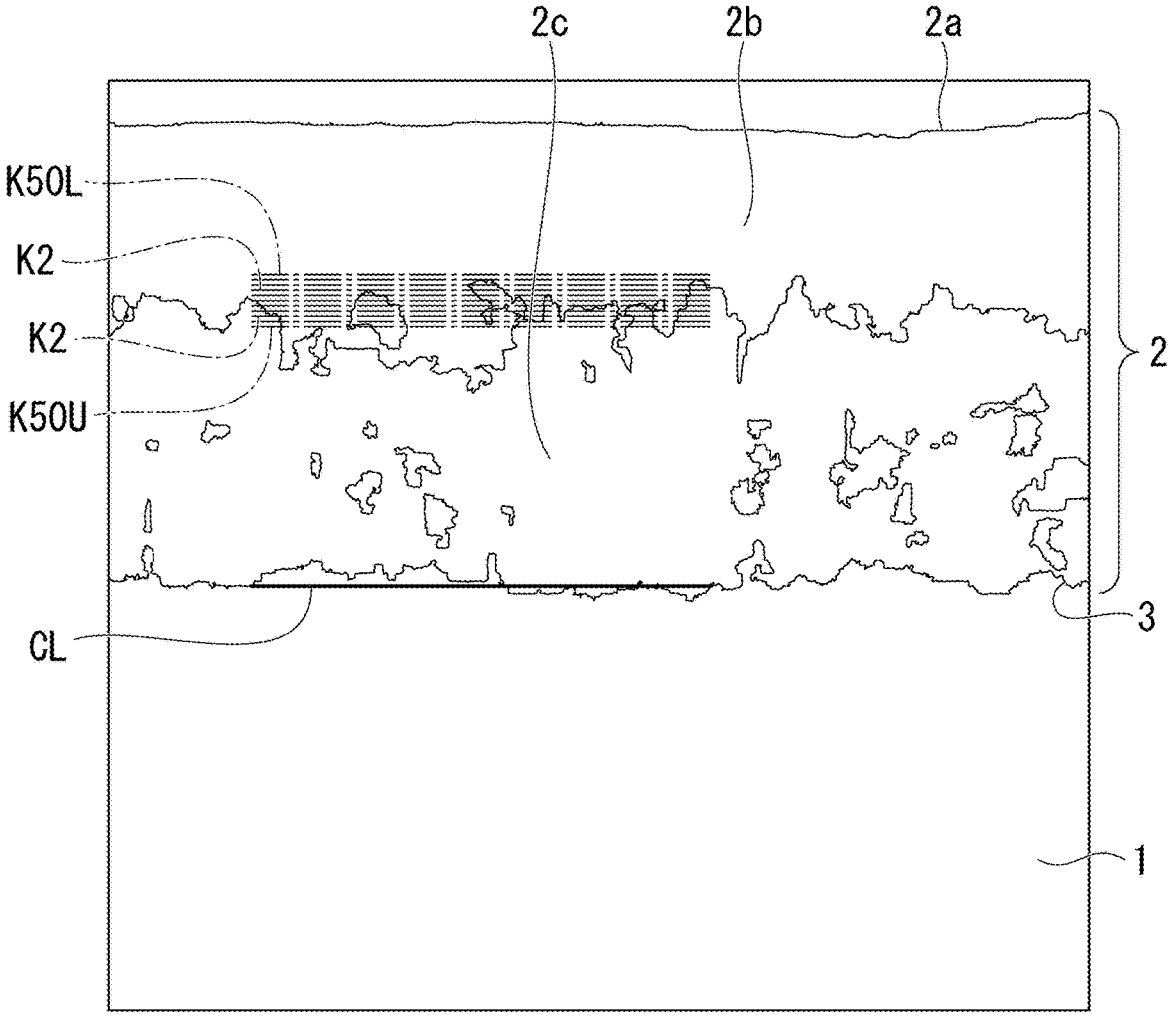
FIG. 1F is an illustration explaining a method for measuring the total thickness of the intermediate alloy layer and the lower alloy layer, and is a schematic illustration showing the cross section of the plated-metal-layer.

Next, as illustrated in FIG. 1F, between the reference lines K50L and K50U, a plurality of second imaginary lines K2 having a length of 40 μm and parallel to the reference lines K50L and K50U are set at intervals of 1 μm. Thereafter, the reference lines K50L and K50U are included in the second imaginary lines K2.

Next, for each of the second imaginary lines K2, the length of the part where the measured alloy overlaps with the second imaginary line K2 is measured. Further, for each of the second imaginary lines K2, the ratio (%) of the length of the part overlapping the measured alloy to the total length of the second imaginary line K2 (40 μm) is determined. The method for measuring the ratio (%) of the length of the part overlapping the measured alloy to the total length of the second imaginary line K2 is the same as in the case of the first imaginary line K1.

Figure 1G:
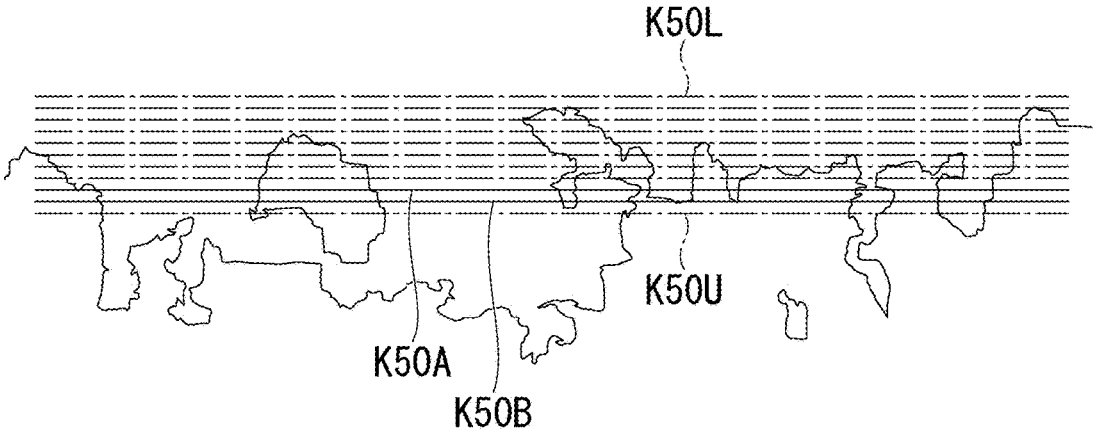
FIG. 1G is an illustration explaining a method for measuring the total thickness of the intermediate alloy layer and the lower alloy layer, and is a schematic illustration showing the cross section of the plated-metal-layer.

Next, as shown in FIG. 1G, among the plurality of second imaginary lines K2, the second imaginary lines K50 in which the ratio of the part overlapping with the measured alloy is less than 50% are specified. Further, among the specified second imaginary lines K50, the imaginary line K50A located closest to the steel material side is specified. Further, the imaginary line K50B which is located on the steel material side from the imaginary line K50A and is most adjacent to the imaginary line K50A is specified.

Figure 1H:
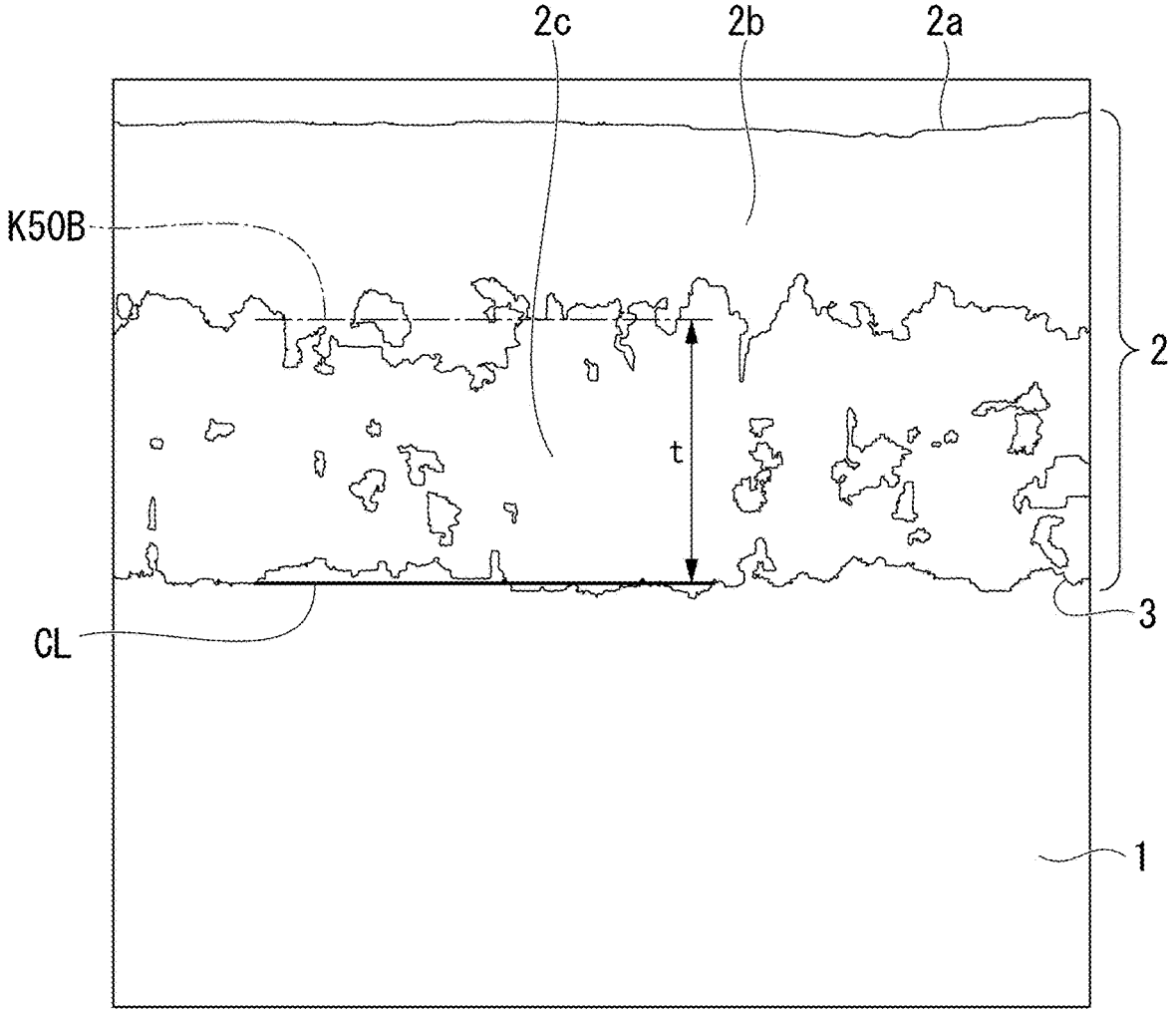
FIG. 1H is an illustration explaining a method for measuring the total thickness of the intermediate alloy layer and the lower alloy layer, and is a schematic illustration showing the cross section of the plated-metal-layer.
Figure 2:
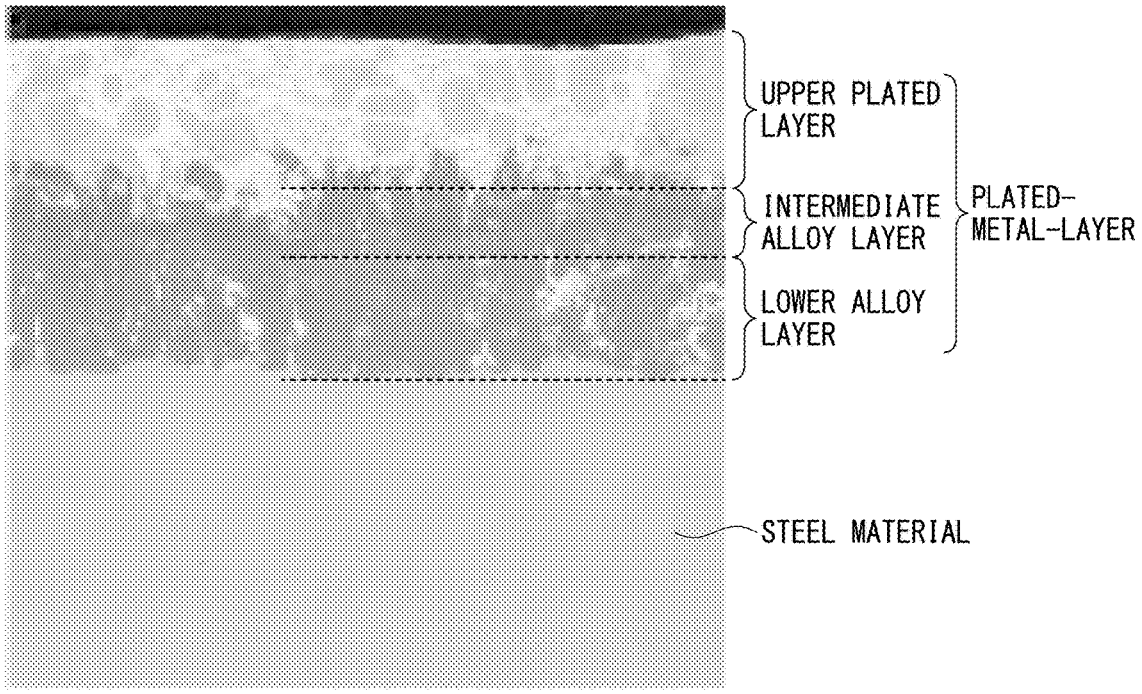
FIG. 2 is a cross-sectional SEM micrograph of the plated-metal-layer in Example No. 12.
Figure 3:
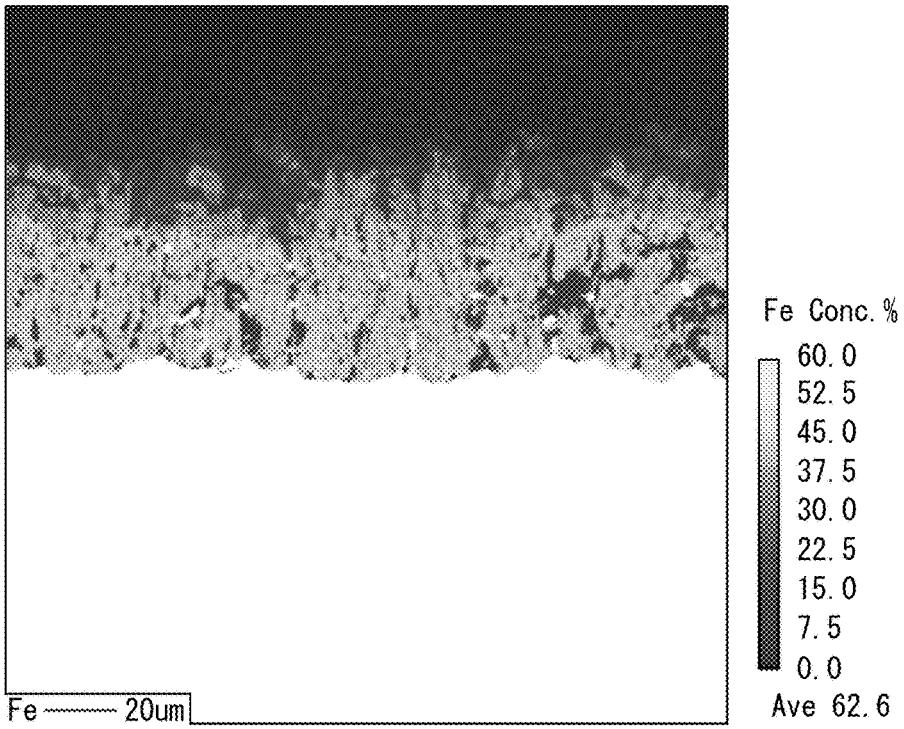
FIG. 3 shows an element mapping analysis result of Fe included in the plated-metal-layer in Example No. 12.

Then, as illustrated in FIG. 1H, the distance t between the imaginary line 50B and the straight line CL is defined as the thickness of the alloy layer.

The above operation is performed on five SEM images, and the average value of the thickness of the alloy layer obtained from the SEM images is defined as the total thickness of the alloy layer, that is, the intermediate alloy layer and the lower alloy layer.

The thickness of the upper plated layer is a value obtained by subtracting the thickness of the alloy layer from the thickness of the plated-metal-layer.

The thickness of the intermediate alloy layer is measured in an EPMA image of the plated-metal-layer in a cross section perpendicular to the surface of the plated steel material. Specifically, the SEM image used for measuring the thickness of the alloy layer is subjected to element mapping of Ni with an electron beam probe microanalyzer (EPMA), and the region where Ni is 0.5% or more is extracted by image processing. The EPMA measurement conditions are the same as the measurement conditions for determining the area fraction of the quasicrystal phase.

Next, in the same manner as in the measurement of the thickness of the alloy layer, imaginary lines having a length of 40 μm and parallel to the center line CL of the roughness curve of the steel material surface are drawn, the imaginary lines in which the ratio of the length of the part overlapping with the region having 0.5% or more of Ni (Al—Fe—Ni-based alloy) is 50% or more are specified, and among them, the imaginary line closest to the center line CL of the roughness curve is defined as the boundary line of the intermediate alloy layer. For the thickness of the intermediate alloy layer, in five views of SEM images, the distance between the boundary line of the intermediate alloy layer and the imaginary line 50B specified in FIGS. 1B to 1G is measured, and the average thereof is defined as the thickness of the intermediate alloy layer.

For the composition of the intermediate alloy layer, in five views, elements are subjected to EPMA area analysis in the region surrounded by the boundary line of the intermediate alloy layer, the perpendicular lines drawn from each of the both ends of the boundary line of the intermediate alloy layer in the surface thickness direction, and the imaginary line 50B, and the average is derived and defined as the composition of the intermediate alloy layer. The EPMA measurement conditions are the same as the measurement conditions for determining the area fraction of the quasicrystal phase.

The thickness of the lower alloy layer is derived by subtracting the thickness of the intermediate alloy layer from the thickness of the alloy layer. For the composition of the lower alloy layer, the region of the lower alloy layer is defined as a region formed such that perpendicular lines are drawn from the center line CL of the roughness curve of the steel material surface to the boundary line of the intermediate alloy layer, elements are subjected to EPMA area analysis in the region of the lower alloy layer, and the average is derived and defined as the composition of the lower alloy layer. The EPMA measurement conditions are the same as the measurement conditions for determining the area fraction of the quasicrystal phase.

The method for confirming the form of the intermediate alloy layer will be described. Whether the metallographic structure in the intermediate alloy layer is a mixed phase structure or a homogeneous structure can be determined by components obtained by area analysis. That is, the mixed phase structure has the Fe content of less than 20%, which is lower than that of the homogeneous structure. Therefore, determination can be made based on the Fe content.

Next, in the plated steel material according to the embodiment, the plated-metal-layer preferably includes no halide. Specifically, in fluorescent X-ray analysis, the fluorescent X-ray intensity of halogen elements in the plated-metal-layer is preferably in a range of 0 to 0.6 kcps.

In the plated steel material according to the embodiment, as described later, the plated-metal-layer is formed by performing a flux treatment to the surface of the steel material, and then dipping the steel material in a plating bath. However, when Al and Mg are contained in a total amount of 5% or more in the plating bath, significant adhesion of a flux residue may be caused. When an excessive flux residue remains in the plated-metal-layer, bare spots may be generated to deteriorate the corrosion resistance of the plated-metal-layer. As the flux residue, magnesium chloride, aluminum chloride, and the like are conceivable.

Therefore, in the embodiment, a flux containing no $NH_4Cl$ is selected as a countermeasure for reducing a flux residue which causes bare spots. As a result, a flux residue hardly remains in the plated-metal-layer, the occurrence of bare spots is suppressed, and the corrosion resistance of the plated-metal-layer is less likely to deteriorate. The flux residue included in the plated-metal-layer can be evaluated by the fluorescent X-ray intensity of halogen elements in the plated-metal-layer. When the fluorescent X-ray intensity of halogen elements in the plated-metal-layer is in a range of 0 to 0.6 kcps in fluorescent X-ray analysis, the flux residue is extremely reduced, and the corrosion resistance is less likely to be adversely affected.

The fluorescent X-ray intensity of halogen elements in the plated-metal-layer is measured as follows.

Fluorescent X-ray analysis is performed to the surface of the plated steel material (the surface of the plated-metal-layer) using ZSXPrismIII+, which is manufactured by Rigaku Corporation, as an analyzer. The analysis range is the inside of a circle having a diameter of 30 mm. The measurement is performed by upper surface irradiation with a setting of the EZ-scan program (target: Rh, 30 kV-80 mA, dispersive crystal: Ge, detector: proportional counter, measurement peak: 92.8°, detector speed: 10 deg/min).

Next, the manufacturing method of the plated steel material according to an embodiment of the present invention will be described. The plated steel material according to the embodiment is manufactured as follows: the surface of the steel material is cleaned by degreasing and pickling, and further subjected to a flux treatment, followed by performing a hot-dip plating method (batch type hot-dip plating method).

The size, shape, surface form, and the like of the steel material to be plated are not particularly limited. Ordinary steel materials, high tensile strength steel, stainless steel, and the like are applicable as long as they are steel materials. More specifically, for instance, various steel materials, such as general steel, Ni pre-plated steel, Al-killed steel, ultra-low carbon steel, high carbon steel, various high tensile strength steels, and some high alloy steels (a steel containing a reinforcing element such as Ni, Cr, etc.) are applicable. A steel strip of general structural steel is most preferable.

The surface of the steel material may be finished by shot blasting, brush grinding, or the like in advance. There is no problem even if plating is performed after a metal film or an alloy film of Ni plating, Zn plating, Sn plating, or the like is adhered in an adhesion amount of 3 $g/m^2$ or less to the surface.

In addition, as a pretreatment of the steel material, the steel material is sufficiently cleaned by degreasing and pickling. Conditions for degreasing and pickling are not particularly limited.

Subsequently, the surface of the cleaned steel material is subjected to a flux treatment. In the flux treatment, for instance, the steel material is immersed in a flux aqueous solution at about 60° C. for 20 seconds or more, pulled up, and dried. The flux to be used is solution in which various salts such as NaCl, NaF, KCl, $SnCl_2$, $SnCl_4$, and $BiCl_3$, a surfactant, and the like are dissolved based on $ZnCl_2$, and which is acidified with hydrochloric acid as necessary. When the steel material before plating is applied with a flux, the plated-metal-layer is obtained, in which Ni is segregated in the intermediate alloy layer.

As the flux, it is preferable to use a flux containing no $NH_4Cl$ from the viewpoint of not generating a flux residue. Examples of the flux include a flux in which a flux composition made of 5 to 14 mass % of NaCl, 1.2 to 5 mass % of $BiCl_3$, 7 to 18 mass % of KCl, and a balance including $ZnCl_2$ is dissolved in water in a concentration of 150 to 300 g/L, and the pH is adjusted to 1.5 or less. As another example, a flux containing, in terms of mol %, (a) $ZnCl_2$ in an amount of 65 to 85%, (b) any one or more of NaF, KF, $MgF_2$, and $Na_2SiF_6$, in a total amount of 0.5 to 3%, (c) any one or more of chlorides of an alkali metal element or an alkaline earth metal element in a total amount of 5 to 25%, and (d) one or more of chlorides of Sn, In, Tl, Sb, and Bi, in a total amount of more than 5% and 20% or less can be exemplified.

According to the flux, when the plated steel material is manufactured by the one-stage plating method, a flux residue is less likely to remain in the steel material or on the plated surface. Thus, the plated steel material having sufficient corrosion resistance can be obtained.

Next, the steel material after the flux treatment is dipped in a plating bath mixed with predetermined composition. The composition of the plating bath may be substantially the same as the target composition of the upper plated layer. However, among the constituent elements of the plating bath, Al, Ni, and the like are concentrated in the lower alloy layer and the intermediate alloy layer. Therefore, based on the target composition of the upper plated layer, the composition of the plating bath preferably contains a larger amount of Al and Ni than the target composition of the upper plated layer. For instance, the Al content in the plating bath is increased by about 1.5 to 5 mass % with respect to the Al content (mass %) in the upper plated layer, and the Ni content in the plating bath is 5 to 20 times the Ni content (mass %) in the upper plated layer.

Specifically, in order to obtain the alloy layer of the present invention, the plating bath composition is required to have the Al content of 2.0 to 84.98 mass %, the Zn content of 15.0 to 97.98 mass %, and the Ni content of 0.02 to less than 3.0 mass %. Furthermore, in order to form the upper plated layer in a suitable range, the plating bath composition preferably has the Al content of 7.5 to 30.0 mass %, the Zn content of more than 50% to less than 89.48 mass %, the Ni content of 0.02 to less than 3.0 mass %, and the Mg content of more than 3.0 to 12.5 mass %.

The bath temperature of the plating bath is 440 to 600° C., and preferably 460 to 520° C. When the bath temperature is high, the lower alloy layer rapidly grows and the productivity is excellent, but the Al—Fe reaction cannot be controlled. When the bath temperature is low, plating defects such as bare spots are likely to occur. Particularly, when the Mg content is high, plating defects such as bare spots are more likely to occur. In addition, the Al—Fe reaction is suppressed, and an alloy layer having an appropriate thickness is not formed. Therefore, the bath temperature of the plating bath is 440 to 600° C. When the bath temperature increases, the Fe content in the upper plated layer may increase. However, when the bath temperature is 600° C. or lower, the content of Fe included in the upper plated layer usually falls within 5.00% or less.

The dipping time of the steel material in the plating bath is 50 seconds or more and 1000 seconds or less, and preferably 100 seconds or more and 600 seconds or less. Although the dipping time is directly linked to productivity, it is needless to say that the dipping time is not strictly determined due to the nature of the flux type dipping plating. The bath temperature and the dipping time are selected in consideration of the heat capacity of a plated object and from the viewpoint of the balance between productivity and quality. Therefore, the bath temperature and the dipping time are not uniquely determined.

When a steel material having a predetermined shape such as a bolt or a screw is plated, the steel material is pulled up from the plating bath and then centrifuged to adjust the adhesion amount of molten metal and adjust the plated-metal-layer within a predetermined thickness.

After the thickness of the plated-metal-layer is adjusted, the plated-metal-layer is immediately cooled. The cooling for solidifying the molten metal is atmospheric cooling or air cooling. The average cooling rate from the start of cooling to the end of cooling is adjusted as follows according to the temperature of the plating bath.

When the temperature of the plating bath is higher than 500° C., the average cooling rate is 4 to 6° C./s from the bath temperature to 500° C., and the average cooling rate is 2 to 5° C./s from 500° C. to 300° C.

When the temperature of the plating bath is 500° C. or lower, the average cooling rate is 2 to 5° C./s from the bath temperature to 300° C.

When the temperature of the plating bath is higher than 500° C. and the average cooling rate from the bath temperature to 500° C. is higher than 6° C./s, the area fraction of the quasicrystal phase may increase, and an alloy layer having a desired composition is not obtained in some cases.

In addition, when the average cooling rate from the bath temperature to 500° C. is less than 4° C./s, the Al—Fe reaction is not suppressed, and an alloy layer having a desired composition is not obtained in some cases.

In addition, when the average cooling rate from 500° C. to 300° C. is more than 5° C./s, an alloy layer having a desired composition is not obtained in some cases.

In addition, when the average cooling rate from 500° C. to 300° C. is less than 2° C./s, the Al—Fe reaction is not suppressed, and an alloy layer having a desired composition is not obtained in some cases.

When the temperature of the plating bath is 500° C. or less and the average cooling rate from the bath temperature to 300° C. is higher than 5° C./s, an alloy layer having a desired composition is not obtained in some cases.

In addition, when the average cooling rate from the bath temperature to 300° C. is less than 2° C./s, the Al—Fe reaction is not suppressed, and an alloy layer having a desired composition is not obtained in some cases.

After the temperature of the plated steel material becomes 300° C. or lower by atmospheric cooling or air cooling, water cooling may be performed. When water cooling is performed, from the viewpoint of preventing surface irregularities of the plated-metal-layer, the plated steel material is preferably submerged after the upper plated layer has been solidified and formed.

As described above, the plated steel material according to the embodiment is manufactured.

After the plated layer is cooled, various chemical conversion treatments and coating treatments may be performed. In addition, in order to further enhance the corrosion resistance, repair touch-up paint application, thermal spraying treatment, and the like may be performed in a welded portion, a processed portion, and the like.

In the plated steel material according to the embodiment, a film may be formed on the plated layer. A film having a single layer or two or more layers may be formed. Examples of the type of the film immediately above the plated layer include a chromate film, a phosphate film, and a chromate-free film. The chromate treatment, the phosphating treatment, and the chromate-free treatment for forming these films can be performed by known methods. It is noted that many chromate treatments may deteriorate weldability on the surface of the plated layer. Therefore, the thickness of the film is preferably less than 1 μm in order to sufficiently obtain weldability improving effect in the plated layer.

The chromate treatment includes an electrolytic chromate treatment in which a chromate film is formed by electrolysis, a reaction type chromate treatment in which a film is formed by utilizing a reaction with the material and then the excess treatment liquid is washed away, and an application type chromate treatment in which a film is formed by applying a treatment liquid to an object to be coated and drying the treatment liquid without washing with water. Any treatment may be adopted.

Examples of the electrolytic chromate treatment include an electrolytic chromate treatment using chromic acid, a silica sol, a resin (phosphoric acid, an acrylic resin, a vinyl ester resin, a vinyl acetate acrylic emulsion, a carboxylated styrene-butadiene latex, a diisopropanolamine-modified epoxy resin, and the like), and hard silica.

Examples of the phosphating treatment include a zinc phosphate treatment, a zinc calcium phosphate treatment, and a manganese phosphate treatment.

The chromate-free treatment which does not impose a burden on the environment is particularly suitable. The chromate-free treatment includes an electrolytic chromate-free treatment in which a chromate-free film is formed by electrolysis, a reaction type chromate-free treatment in which a film is formed by utilizing a reaction with the material and then the excess treatment liquid is washed away, and an application type chromate-free treatment in which a film is formed by applying a treatment liquid to an object to be coated and drying the treatment liquid without washing with water. Any treatment may be adopted.

Further, an organic resin film made of a single layer or two or more layers may be formed on the film immediately above the plated layer. The organic resin is not limited to a specific type, and examples thereof include polyester resins, polyurethane resins, epoxy resins, acrylic resins, polyolefin resins, and modified products of these resins. Here, the modified product refers to a resin obtained by causing a reactive functional group included in the structures of these resins to react with another compound (a monomer, a crosslinking agent, or the like) having a functional group capable of reacting with the functional group in the structure thereof.

As such an organic resin, one or more types of organic resins (unmodified organic resins) may be mixed and used, or one or more types of organic resins obtained by modifying, in the presence of at least one type of organic resin, at least one type of other organic resin may be mixed and used. The organic resin film may contain any coloring pigment or rust preventive pigment. Also, water-based organic resins which is dissolved or dispersed in water may be used.

EXAMPLES

Hereinafter, examples of the present invention are described.

The original sheet of the plated steel material was cut out in a size of 200 mm×100 mm from a hot-rolled steel sheet having a thickness of 1.6 mm. The original sheets were SS400 (general steel with mill scale). The surface was washed with a commercially available alkaline degreasing agent, and then washed with 10% hydrochloric acid to remove scale on the surface. The steel sheet after pickling was washed with hot water at 60° C., then immersed in a flux ($ZnCl_2$/NaCl/KCl/$SnCl_2$=200 (g/l)/20 (g/l)/40 (g/l)/6 (g/l), pH=1.0) at 60° C. for about 1 minute, and heated and dried in a heating furnace at 200° C. for 5 minutes in the air atmosphere. This steel sheet was dipped in a plating bath for 60 to 900 seconds for plating, then pulled up, allowed to natural atmospheric cooling, and cooled with water after the plating was completely solidified. In the natural atmospheric cooling, when the bath temperature was more than 500° C., the average cooling rate was 4 to 8° C./s from the bath temperature to 500° C., and the average cooling rate was 2 to 5° C./s from 500° C. to 300° C. When the bath temperature was 500° C. or lower, the average cooling rate was 2 to 5° C. from the bath temperature to 300° C. In this way, plated steel materials of No. 1 to 31 and 37 were manufactured by the one-stage plating method.

For the plated steel materials of No. 32 to 36, the original sheet was subjected to surface washing and pickling in the same manner as described above, then subjected to a flux treatment in the same manner as described above, and subsequently dipped in a galvanizing bath to form a galvanized layer having a thickness of 50 μm on the surface of the steel material. Next, in the same manner as described above, the steel sheet having a galvanized layer formed thereon was dipped in a plating bath for 60 to 120 seconds for plating, then pulled up, allowed to natural atmospheric cooling, and cooled with water after the plating was completely solidified. In this way, various plated steel materials were manufactured by the two-stage plating method. The natural atmospheric cooling conditions were as described in the tables.

Although the composition of the plating bath was substantially the same as the composition of the upper plated layer as described in Tables 1A and 1B, the Al content of the plating bath was increased by about 0 to 5 mass % with respect to the Al content (mass %) of the plated layer, and the Ni content of the plating bath was 5 to 20 times the Ni content (mass %) of the upper plated layer. However, the plating baths in No. 25 to 28, 31, and 37 were out of the preferred composition.

(Measurement of Chemical Composition and Thickness of Upper Plated Layer)

The composition of the upper plated layer was measured by ICP emission spectrometry. Specifically, the test material was immersed and dissolved in a 5% NaOH aqueous solution to which an inhibitor was added, thereby obtaining solution in which the upper plated layer was peeled off and dissolved. The end point of alkali dissolution was the time point at which foaming from the surface of the immersed test material was stopped and 90% or more of the surface changed to a black appearance due to exposure of the alloy layer. The obtained solution was subjected to an acid treatment by adding HCl, and then the composition thereof was analyzed by an emission spectroscopic analysis method.

The thickness of the upper plated layer was determined by subtracting the thickness of the alloy layer described later from the thickness of the plated-metal-layer. The thickness of the plated-metal-layer was derived by cross-sectional microstructure observation. Specifically, in a SEM reflected electron image of the cross section of the plated-metal-layer, the distance between the outermost surface of the plated-metal-layer and the steel material was measured at 10 points, and the average value thereof was calculated as the thickness of the plated-metal-layer. The distance between the measurement points was about 100 μm. Then, from the thickness of the plated-metal-layer, the thickness of the alloy layer described later was subtracted. Thus, the thickness of the upper plated layer was derived.

(Measurement of Chemical Composition and Thickness of Alloy Layer)

The thickness of the alloy layer (the total thickness of the lower alloy layer and the intermediate alloy layer) was measured as described above. However, in No. 26, since there was a region not containing Al, the region containing 5% or more of Fe was measured as the alloy layer.

The thickness of the intermediate alloy layer was measured as described above. However, in No. 26, since Al was not included and the alloy layer was formed of a Fe—Zn-based alloy, the (phase was measured as the intermediate alloy layer, and the y phase was measured as the lower alloy layer. The composition of the intermediate alloy layer was measured as described above.

The thickness of the lower alloy layer was derived by subtracting the thickness of the intermediate alloy layer from the thickness of the alloy layer. The composition of the lower alloy layer was measured as described above.

The method for confirming the form of the intermediate alloy layer will be described. Whether the metallographic structure in the intermediate alloy layer is a mixed phase structure or a homogeneous structure was determined by components obtained by EPMA element mapping analysis. That is, the mixed phase structure has the Fe content of less than 20%, which is lower than that of the homogeneous structure. Therefore, determination was made based on the Fe content.

The measurement of the area fraction of the quasicrystal phase in the upper plated layer and the measurement of the amount of chlorine (Cl) in the plated-metal-layer were performed as described above.

(Evaluation of Corrosion Resistance)

The test material was cut into 120×50 mm, and a test in accordance with JASOM609 was performed to confirm the state of red rust generation. When the area fraction of red rust was 5% or more of the test area, it was deemed that red rust was generated.

Corrosion resistance was evaluated as follows. "B" was defined as unacceptable, and "A" to "S" were defined as acceptable.

Generation of red rust was observed in less than 450 cycles: "B" Red rust was generated in 450 to 600 cycles: "A" Red rust was generated in 600 to 750 cycles: "AA" Red rust was generated in 750 to 900 cycles: "AAA"

Red rust was not generated in 900 cycles: "S"

Figure 4:
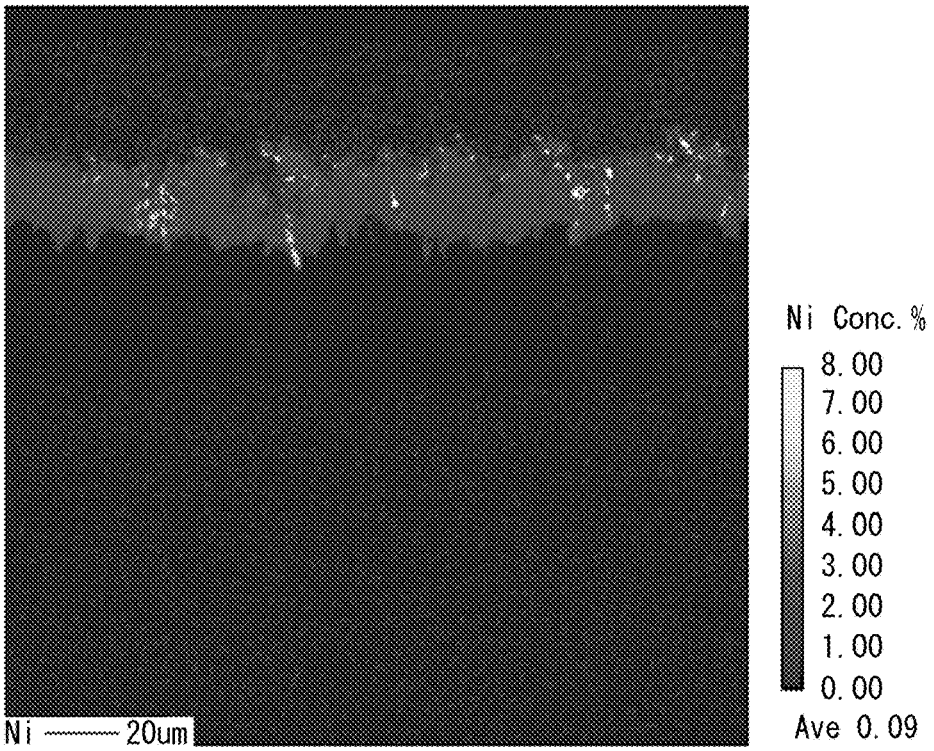
FIG. 4 shows an element mapping analysis result of Ni included in the plated-metal-layer in Example No. 12.
Figure 5:
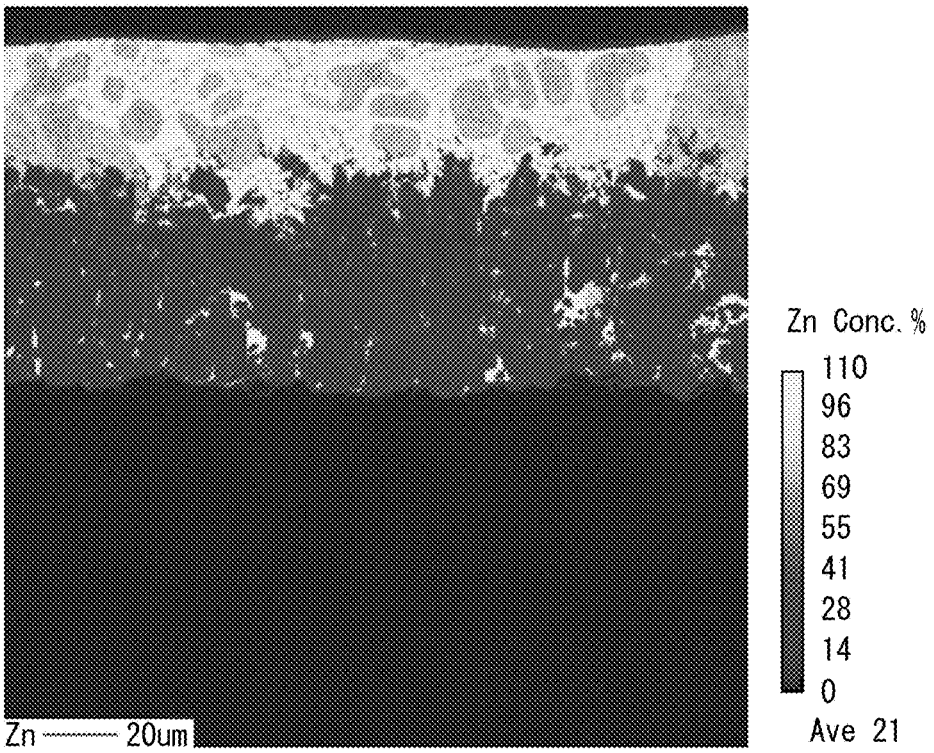
FIG. 5 shows an element mapping analysis result of Zn included in the plated-metal-layer in Example No. 12.
Figure 6:
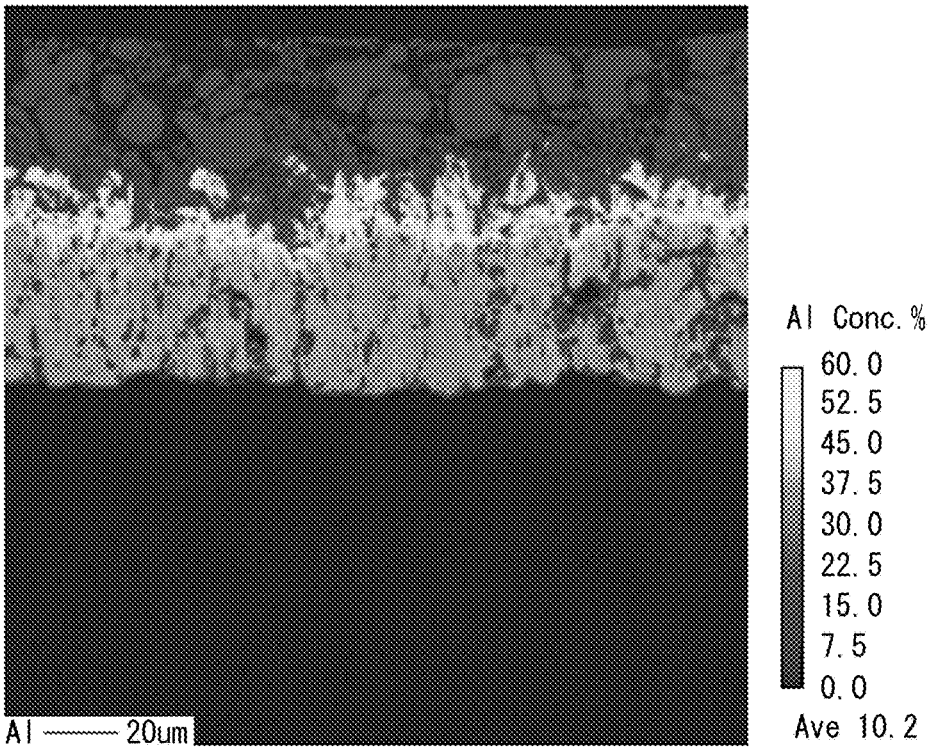
FIG. 6 shows an element mapping analysis result of Al included in the plated-metal-layer in Example No. 12.
Figure 7:
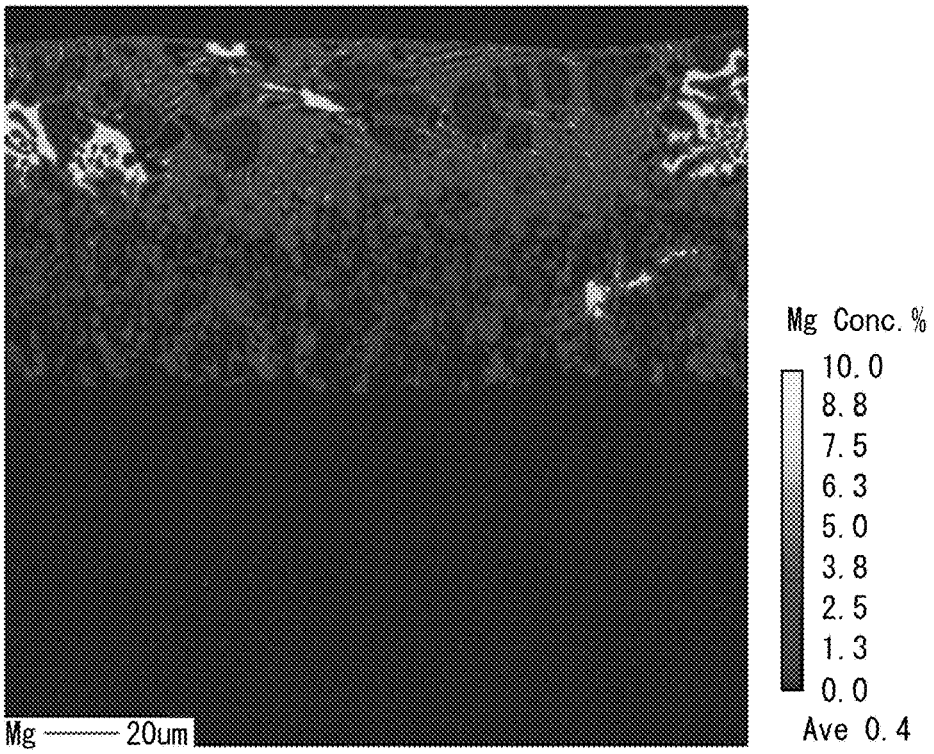
FIG. 7 shows an element mapping analysis result of Mg included in the plated-metal-layer in Example No. 12.

As shown in Tables 1A to 4B, in No. 1 to 24, 29, and 30 (all examples), the chemical composition of the intermediate alloy layer and the lower alloy layer and the thickness of each layer fall within the scope of the present invention, and the corrosion resistance was good. FIGS. 2 to 7 show a cross-sectional SEM micrograph of a plated-metal-layer and the results of area analysis for each element in No. 12. In particular, as shown in FIG. 4, it was confirmed that Ni was concentrated in the region where the intermediate alloy layer was present.

In No. 25 to 28 and 31, since the composition of the plating bath was not appropriate, the chemical composition of the intermediate alloy layer and the lower alloy layer or the thickness of each layer was out of the scope of the present invention, and the corrosion resistance was deteriorated.

That is, in No. 25, the Si content in the plating bath was 2.5%. However, since the content was relatively high, the growth of the intermediate alloy layer and the lower alloy layer was suppressed, the thickness of these alloy layers was reduced, and the corrosion resistance was deteriorated.

In No. 26, the Al content in the plating bath was 0.1%. However, since the content was relatively low, the Fe—Al-based alloy was not sufficiently formed, the Al amount in the intermediate alloy layer and the lower alloy layer was insufficient, and the corrosion resistance was deteriorated.

In No. 27, since the Ni content of the plating bath was 3.0%, the Ni content in the plating bath was excessive, so that the amount of Ni in the intermediate alloy layer was excessive, and the corrosion resistance was deteriorated.

In No. 28, since the Ni content of the plating bath was 0%, the intermediate alloy layer was not formed, and the corrosion resistance was deteriorated.

In No. 31, since the Zn content in the plating bath was insufficient, the amount of Zn in the intermediate alloy layer and the lower alloy layer was insufficient, and the corrosion resistance was deteriorated.

In No. 37, since the manufacturing conditions were not appropriate, the quasicrystal phase was precipitated in an amount of 10% in terms of volume fraction in the upper plated layer, the chemical composition range of the alloy layer was out of the present invention, and the corrosion resistance was deteriorated.

In each of No. 32 and 34 to 36, the plated steel material was manufactured by the two-stage plating method. However, the composition of the intermediate alloy layer and the lower alloy layer did not satisfy the scope of the present invention, and the corrosion resistance was deteriorated. In No. 32 and 34 to 36, the metallographic structure in the intermediate alloy layer was a mesh-like mixed phase.

In No. 33, the plated steel material was manufactured by the two-stage plating method. However, since the composition of the plating bath was not appropriate, the intermediate alloy layer was not formed.

TABLE 1A

| No. | MANUFACTURING METHOD | DIPPING TIME (SECOND) | TEMPERATURE OF PLATING BATH (° C.) | AVERAGE COOLING RATE TO 500° C. ° C./s | AVERAGE COOLING RATE FROM 500° C. TO 300° C. ° C./s | NOTE |
|---|---|---|---|---|---|---|
| 1 | ONE-STAGE | 300 | 600 | 6 | 5 | EXAMPLE |
| 2 | ONE-STAGE | 120 | 500 | — | 4 | EXAMPLE |
| 3 | ONE-STAGE | 120 | 450 | — | 4 | EXAMPLE |
| 4 | ONE-STAGE | 300 | 480 | — | 3 | EXAMPLE |
| 5 | ONE-STAGE | 300 | 480 | — | 3 | EXAMPLE |
| 6 | ONE-STAGE | 120 | 480 | — | 3 | EXAMPLE |
| 7 | ONE-STAGE | 120 | 480 | — | 3 | EXAMPLE |
| 8 | ONE-STAGE | 120 | 480 | — | 3 | EXAMPLE |
| 9 | ONE-STAGE | 900 | 500 | — | 2 | EXAMPLE |
| 10 | ONE-STAGE | 90 | 500 | — | 4 | EXAMPLE |
| 11 | ONE-STAGE | 120 | 500 | — | 4 | EXAMPLE |
| 12 | ONE-STAGE | 120 | 500 | — | 3 | EXAMPLE |
| 13 | ONE-STAGE | 600 | 520 | 5 | 5 | EXAMPLE |
| 14 | ONE-STAGE | 300 | 500 | — | 2 | EXAMPLE |
| 15 | ONE-STAGE | 300 | 500 | — | 3 | EXAMPLE |
| 16 | ONE-STAGE | 120 | 500 | — | 3 | EXAMPLE |
| 17 | ONE-STAGE | 120 | 500 | — | 3 | EXAMPLE |
| 18 | ONE-STAGE | 300 | 500 | — | 3 | EXAMPLE |
| 19 | ONE-STAGE | 600 | 500 | — | 2 | EXAMPLE |
| 20 | ONE-STAGE | 120 | 520 | 4 | 3 | EXAMPLE |

TABLE 1B

| No. | MANUFACTURING METHOD | DIPPING TIME (SECOND) | TEMPERATURE OF PLATING BATH (° C.) | AVERAGE COOLING RATE TO 500° C. ° C./s | AVERAGE COOLING RATE FROM 500° C. TO 300° C. ° C./s | NOTE |
|---|---|---|---|---|---|---|
| 21 | ONE-STAGE | 120 | 520 | 4 | 3 | EXAMPLE |
| 22 | ONE-STAGE | 300 | 520 | 4 | 3 | EXAMPLE |
| 23 | ONE-STAGE | 300 | 560 | 6 | 3 | EXAMPLE |
| 24 | ONE-STAGE | 60 | 600 | 6 | 5 | EXAMPLE |
| 25 | ONE-STAGE | 90 | 550 | 5 | 5 | COMPARATIVE EXAMPLE |
| 26 | ONE-STAGE | 300 | 450 | — | 3 | COMPARATIVE EXAMPLE |
| 27 | ONE-STAGE | 300 | 600 | 6 | 2 | COMPARATIVE EXAMPLE |
| 28 | ONE-STAGE | 300 | 500 | — | 2 | COMPARATIVE EXAMPLE |
| 29 | ONE-STAGE | 120 | 520 | 4 | 3 | EXAMPLE |
| 30 | ONE-STAGE | 120 | 500 | — | 3 | EXAMPLE |
| 31 | ONE-STAGE | 60 | 650 | 7 | 4 | COMPARATIVE EXAMPLE |
| 32 | TWO-STAGE | 60 | 500 | — | 3 | COMPARATIVE EXAMPLE |
| 33 | TWO-STAGE | 60 | 500 | — | 3 | COMPARATIVE EXAMPLE |
| 34 | TWO-STAGE | 120 | 520 | 4 | 3 | COMPARATIVE EXAMPLE |
| 35 | TWO-STAGE | 120 | 500 | — | 3 | COMPARATIVE EXAMPLE |

TABLE 1B-continued

| No. | MANUFACTURING METHOD | DIPPING TIME (SECOND) | TEMPERATURE OF PLATING BATH (° C.) | AVERAGE COOLING RATE TO 500° C. ° C./s | AVERAGE COOLING RATE FROM 500° C. TO 300° C. ° C./s | NOTE |
|---|---|---|---|---|---|---|
| 36 | TWO-STAGE | 120 | 500 | — | 3 | COMPARATIVE EXAMPLE |
| 37 | ONE-STAGE | 240 | 650 | 8 | 2 | COMPARATIVE EXAMPLE |

THE UNDERLINE INDICATES THAT THE VALUE IS OUT OF THE RANGE OF PREFERABLE PRODUCTION CONDITIONS.

TABLE 2A

| UPPER PLATED LAYER | | | | | | | | | | | | |
|---|---|---|---|---|---|---|---|---|---|---|---|---|
| | COMPOSITION (MASS %) BALANCE: IMPURITIES | | | | | | | | | | | |
| No. | Fe | Al | Mg | Ni | Si | OTHER | Zn | Mg/Al | 2Ca + Sr + Y + La + Ce | THICKNESS (μm) | AREA FRACTION OF QUASICRYSTAL PHASE (%) | NOTE |
| 1 | 1.1 | 40.0 | 0 | 0.02 | 1.5 | — | 57.3 | 0 | 0 | 20.0 | 0 | EXAMPLE |
| 2 | 0.2 | 2.5 | 1.0 | 0.03 | 0 | — | 96.3 | 0.4 | 0 | 15.0 | 0 | EXAMPLE |
| 3 | 0.2 | 2.5 | 3.0 | 0.05 | 0.01 | Li: 0.05%, K: 0.05% | 94.1 | 1.2 | 0 | 15.0 | 0 | EXAMPLE |
| 4 | 0.2 | 5.0 | 1.0 | 0.05 | 0 | V: 0.1%, Cu: 0.05% | 93.5 | 0.2 | 0 | 20.0 | 0 | EXAMPLE |
| 5 | 0.2 | 5.0 | 3.0 | 0.06 | 0 | Zr: 0.05% | 91.6 | 0.6 | 0 | 20.0 | 0 | EXAMPLE |
| 6 | 0.3 | 6.0 | 1.0 | 0.03 | 0 | — | 92.7 | 0.2 | 0 | 35.0 | 0 | EXAMPLE |
| 7 | 0.3 | 6.0 | 2.0 | 0.04 | 0.01 | Mn: 0.1%, W: 0.005% | 91.5 | 0.3 | 0 | 20.0 | 0 | EXAMPLE |
| 8 | 0.3 | 6.0 | 3.5 | 0.08 | 0.01 | — | 90.1 | 0.6 | 0 | 20.0 | 0 | EXAMPLE |
| 9 | 0.3 | 6.0 | 3.5 | 0.09 | 0.01 | Ca: 0.1%, Ba: 0.01% | 90.0 | 0.6 | 0.2 | 5.0 | 0 | EXAMPLE |
| 10 | 0.4 | 12.0 | 0.5 | 0.17 | 0 | La: 0.1%, Ce: 0.1% | 86.7 | 0.04 | 0.2 | 20.0 | 0 | EXAMPLE |
| 11 | 0.4 | 12.0 | 0.5 | 0.18 | 0 | Sn: 0.5% | 86.4 | 0.04 | 0 | 20.0 | 0 | EXAMPLE |
| 12 | 0.4 | 12.0 | 3.0 | 0.08 | 0 | — | 84.5 | 0.3 | 0 | 40.0 | 0 | EXAMPLE |
| 13 | 0.4 | 12.0 | 3.0 | 0.09 | 0.2 | — | 84.3 | 0.3 | 0 | 5.0 | 0 | EXAMPLE |
| 14 | 0.4 | 12.0 | 5.0 | 0.17 | 0 | Cr: 0.01%, Sn: 0.1% | 82.3 | 0.4 | 0 | 40.0 | 0 | EXAMPLE |
| 15 | 0.4 | 12.0 | 5.0 | 0.16 | 0 | B: 0.01%, Ti: 0.02% | 82.4 | 0.4 | 0 | 20.0 | 0 | EXAMPLE |
| 16 | 0.6 | 20.0 | 3.0 | 0.04 | 0.01 | In: 0.1% | 76.2 | 0.2 | 0 | 30.0 | 0 | EXAMPLE |
| 17 | 0.6 | 20.0 | 6.0 | 0.05 | 0.01 | Sr: 0. 05% | 73.2 | 0.3 | 0.05 | 20.0 | 0 | EXAMPLE |
| 18 | 0.6 | 20.0 | 6.0 | 0.05 | 0 | Ca: 0.2%, Y: 0.1%, Sr: 0.05% | 73.0 | 0.3 | 0.55 | 20.0 | 0 | EXAMPLE |
| 19 | 0.6 | 20.0 | 8.0 | 0.07 | 0.01 | Ca: 0.4%, Bi: 0.05%, Cr: 0.05% | 70.8 | 0.4 | 0.8 | 30.0 | 0 | EXAMPLE |
| 20 | 0.7 | 25.0 | 6.0 | 0.07 | 0.01 | Ca: 0.1%, Ag: 0.1% | 67.9 | 0.2 | 0.2 | 20.0 | 0 | EXAMPLE |

TABLE 2B

| UPPER PLATED LAYER | | | | | | | | | | | | |
|---|---|---|---|---|---|---|---|---|---|---|---|---|
| | COMPOSITION (MASS %) BALANCE: IMPURITIES | | | | | | | | | | | |
| No. | Fe | Al | Mg | Ni | Si | OTHER | Zn | Mg/Al | 2Ca + Sr + Y + La + Ce | THICKNESS (μm) | AREA FRACTION OF QUASICRYSTAL PHASE (%) | NOTE |
| 21 | 0.7 | 25.0 | 12.5 | 0.33 | 0 | Ca: 0.5%, Co: 0.1% | 60.8 | 0.5 | 1.0 | 30.0 | 0.5 | EXAMPLE |
| 22 | 0.9 | 30.0 | 8.0 | 0.07 | 0 | Ca: 0.4%, Nb: 0.05% | 60.6 | 0.3 | 0.8 | 10.0 | 0 | EXAMPLE |
| 23 | 1.1 | 40.0 | 6.0 | 0.05 | 0 | Ca: 0.5%, Na: 0.01%, P: 0.01% | 52.3 | 0.2 | 1.0 | 5.0 | 0 | EXAMPLE |
| 24 | 1.5 | 55.0 | 2.0 | 0.05 | 0 | Mo: 0.05% | 41.4 | 0.04 | 0 | 5.0 | 0 | EXAMPLE |
| 25 | 0.4 | 12.0 | 5.0 | 0.03 | 2.0 | — | 80.5 | 0.4 | 0 | 20.0 | 0 | COMPARATIVE EXAMPLE |
| 26 | 0.1 | 0.1 | 0 | 0.05 | 0 | — | 99.7 | 0 | 0 | 15.0 | 0 | COMPARATIVE EXAMPLE |
| 27 | 0.4 | 12.0 | 0.5 | 0.50 | 0.01 | — | 86.6 | 0.04 | 0 | 20.0 | 0 | COMPARATIVE EXAMPLE |
| 28 | 0.4 | 12.0 | 3.0 | 0 | 0 | Cr: 0.01% | 84.5 | 0.3 | 0 | 15.0 | 0 | COMPARATIVE EXAMPLE |
| 29 | 0.6 | 20.0 | 3.5 | 0.04 | 0.01 | In: 0.1%, Cu: 0.1% | 75.6 | 0.2 | 0 | 30.0 | 0 | EXAMPLE |
| 30 | 0.6 | 20.0 | 6.5 | 0.05 | 0.01 | Sr: 0.05%, Sn: 3.0% | 69.7 | 0.3 | 0.05 | 20.0 | 0 | EXAMPLE |
| 31 | 2.5 | 95.0 | 0.5 | 0.03 | 1.5 | Ca: 0.2% | 0.2 | 0.005 | 0.4 | 15.0 | 0 | COMPARATIVE EXAMPLE |
| 32 | 0.2 | 5.0 | 1.0 | 0.05 | 0 | V: 0.1%, Cu: 0.05% | 93.5 | 0.2 | 0 | 20.0 | 0 | COMPARATIVE EXAMPLE |

TABLE 2B-continued

| | UPPER PLATED LAYER | | | | | | | | | | | |
|---|---|---|---|---|---|---|---|---|---|---|---|---|
| | COMPOSITION (MASS %) BALANCE: IMPURITIES | | | | | | | | 2Ca + Sr + Y + | THICK-NESS | AREA FRACTION OF QUASICRYSTAL | |
| No. | Fe | Al | Mg | Ni | Si | OTHER | Zn | Mg/Al | La + Ce | (μm) | PHASE (%) | NOTE |
| 33 | 0.4 | 12.0 | 0.5 | 0 | 0 | Sn: 0.5% | 86.6 | 0.04 | 0 | 20.0 | 0 | COMPARATIVE EXAMPLE |
| 34 | 0.4 | 12.0 | 3.0 | 0.08 | 0.2 | — | 84.3 | 0.3 | 0 | 20.0 | 0 | COMPARATIVE EXAMPLE |
| 35 | 0.6 | 20.0 | 6.0 | 0.05 | 0.01 | Sr: 0.05% | 73.2 | 0.3 | 0.05 | 30.0 | 0 | COMPARATIVE EXAMPLE |
| 36 | 0.6 | 20.0 | 6.0 | 0.05 | 0.01 | Ca: 0.2%, Y: 0.1%, Sr: 0.05% | 72.9 | 0.3 | 0.55 | 20.0 | 0 | COMPARATIVE EXAMPLE |
| 37 | 0.2 | 5.0 | 20.0 | 0.02 | 0 | Ca: 2.0% | 72.7 | 4.0 | 4.0 | 20.0 | 10 | COMPARATIVE EXAMPLE |

THE UNDERLINE INDICATES THAT THE VALUE IS OUT OF THE RANGE OF THE PRESENT INVENTION.

TABLE 3A

| | INTERMEDIATE ALLOY LAYER | | | | | | | | | |
|---|---|---|---|---|---|---|---|---|---|---|
| | COMPOSITION (MASS %) BALANCE: IMPURITIES | | | | | | | THICKNESS | | |
| No. | Zn | Al | Mg | Ni | Si | OTHER | Fe | (μm) | FORM | NOTE |
| 1 | 25.0 | 32.5 | 0 | 0.5 | 8.0 | — | 34.0 | 5.0 | CONTINUOUS | EXAMPLE |
| 2 | 27.5 | 37.5 | 0.1 | 0.9 | 0 | — | 34.0 | 10.0 | CONTINUOUS | EXAMPLE |
| 3 | 27.5 | 37.5 | 0.3 | 1.5 | 0.1 | — | 33.1 | 12.5 | CONTINUOUS | EXAMPLE |
| 4 | 27.5 | 37.5 | 0.1 | 1.5 | 0 | — | 33.4 | 20.0 | CONTINUOUS | EXAMPLE |
| 5 | 27.5 | 35.0 | 0.3 | 1.7 | 0 | — | 35.5 | 20.0 | CONTINUOUS | EXAMPLE |
| 6 | 25.0 | 37.5 | 0.1 | 1.0 | 0 | — | 36.4 | 12.5 | CONTINUOUS | EXAMPLE |
| 7 | 27.5 | 35.0 | 0.1 | 1.1 | 0.1 | Mn: 0.5% | 35.7 | 12.5 | CONTINUOUS | EXAMPLE |
| 8 | 27.5 | 37.5 | 0.3 | 2.5 | 0.1 | — | 32.1 | 15.0 | CONTINUOUS | EXAMPLE |
| 9 | 27.5 | 37.5 | 0.3 | 2.8 | 0.1 | — | 31.8 | 35.0 | CONTINUOUS | EXAMPLE |
| 10 | 27.5 | 32.5 | 0 | 5.0 | 0 | — | 35.0 | 10.0 | CONTINUOUS | EXAMPLE |
| 11 | 25.0 | 37.5 | 0.1 | 5.3 | 0 | — | 32.1 | 17.5 | CONTINUOUS | EXAMPLE |
| 12 | 27.5 | 37.5 | 0.3 | 2.5 | 0 | — | 32.2 | 12.0 | CONTINUOUS | EXAMPLE |
| 13 | 27.5 | 35.0 | 0.3 | 2.6 | 2.0 | — | 32.6 | 5.0 | CONTINUOUS | EXAMPLE |
| 14 | 27.5 | 32.5 | 0.3 | 5.0 | 0 | Cr: 0.1% | 34.6 | 20.0 | CONTINUOUS | EXAMPLE |
| 15 | 27.5 | 32.5 | 0.3 | 4.7 | 0 | — | 35.0 | 22.5 | CONTINUOUS | EXAMPLE |
| 16 | 27.5 | 40.0 | 0.3 | 1.2 | 0.1 | — | 30.9 | 15.0 | CONTINUOUS | EXAMPLE |
| 17 | 27.5 | 37.5 | 0.2 | 1.5 | 0.1 | — | 33.2 | 15.0 | CONTINUOUS | EXAMPLE |
| 18 | 25.0 | 42.5 | 0.3 | 1.5 | 0 | — | 30.7 | 15.0 | CONTINUOUS | EXAMPLE |
| 19 | 22.5 | 40.0 | 0.4 | 2.2 | 0.1 | Cr: 0.2% | 34.6 | 15.0 | CONTINUOUS | EXAMPLE |
| 20 | 25.0 | 37.5 | 0.3 | 2.1 | 0.1 | | 35.0 | 15.0 | CONTINUOUS | EXAMPLE |

TABLE 3B

| | INTERMEDIATE ALLOY LAYER | | | | | | | | | |
|---|---|---|---|---|---|---|---|---|---|---|
| | COMPOSITION (MASS %) BALANCE: IMPURITIES | | | | | | | THICKNESS | | |
| No. | Zn | Al | Mg | Ni | Si | OTHER | Fe | (μm) | FORM | NOTE |
| 21 | 25.0 | 37.5 | 0.4 | 9.8 | 0 | Co: 0.4% | 26.9 | 40.0 | CONTINUOUS | EXAMPLE |
| 22 | 30.0 | 42.5 | 0.4 | 2.0 | 0 | — | 25.1 | 35.0 | CONTINUOUS | EXAMPLE |
| 23 | 25.0 | 42.5 | 0.3 | 1.5 | 0 | — | 30.7 | 35.0 | CONTINUOUS | EXAMPLE |
| 24 | 22.5 | 50.0 | 0.2 | 1.4 | 0 | Mo: 0.2% | 25.7 | 1.0 | CONTINUOUS | EXAMPLE |
| 25 | 25.0 | 35.0 | 0.3 | 0.8 | 8.0 | — | 30.9 | 0.5 | CONTINUOUS | COMPARATIVE EXAMPLE |
| 26 | 94.0 | 0 | 0 | 0.1 | 0 | — | 5.9 | 20.0 | CONTINUOUS | COMPARATIVE EXAMPLE |
| 27 | 22.5 | 32.5 | 0.3 | 12.0 | 0.1 | — | 32.6 | 30.0 | CONTINUOUS | COMPARATIVE EXAMPLE |
| 28 | — | — | — | — | — | — | — | — | — | COMPARATIVE EXAMPLE |
| 29 | 27.5 | 42.5 | 0.3 | 1.2 | 0.1 | — | 28.4 | 15.0 | CONTINUOUS | EXAMPLE |
| 30 | 27.5 | 37.5 | 0.2 | 1.5 | 0.1 | — | 33.2 | 15.0 | CONTINUOUS | EXAMPLE |
| 31 | 0 | 37.5 | 0.1 | 1.0 | 5.0 | — | 56.4 | 15.0 | CONTINUOUS | COMPARATIVE EXAMPLE |
| 32 | 60.0 | 22.5 | 0.4 | 1.5 | 0 | — | 15.6 | 40.0 | MESH-LIKE | COMPARATIVE EXAMPLE |

TABLE 3B-continued

| | INTERMEDIATE ALLOY LAYER | | | | | | | | | |
|---|---|---|---|---|---|---|---|---|---|---|
| | COMPOSITION (MASS %) BALANCE: IMPURITIES | | | | | | | THICKNESS | | |
| No. | Zn | Al | Mg | Ni | Si | OTHER | Fe | (μm) | FORM | NOTE |
| 33 | — | — | — | — | — | — | — | — | — | COMPARATIVE EXAMPLE |
| 34 | 60.0 | 22.5 | 1.2 | 2.5 | 2.0 | — | 11.8 | 40.0 | MESH-LIKE | COMPARATIVE EXAMPLE |
| 35 | 60.0 | 22.5 | 2.4 | 1.5 | 0.1 | — | 13.5 | 40.0 | MESH-LIKE | COMPARATIVE EXAMPLE |
| 36 | 55.0 | 22.5 | 2.4 | 1.5 | 0.1 | — | 18.5 | 40.0 | MESH-LIKE | COMPARATIVE EXAMPLE |
| 37 | 20.0 | 37.5 | 1.0 | 0.5 | 0 | — | 41.0 | 0.5 | CONTINUOUS | COMPARATIVE EXAMPLE |

THE UNDERLINE INDICATES THAT THE VALUE IS OUT OF THE RANGE OF THE PRESENT INVENTION.

TABLE 4A

| | LOWER ALLOY LAYER | | | | | | | | THICKNESS OF ALLOY LAYER | THICKNESS OF PLATED-METAL-LAYER | PERFORMANCE CORROSION RESISTANCE | CI INTENSITY | |
|---|---|---|---|---|---|---|---|---|---|---|---|---|---|
| | COMPOSITION (MASS %) BALANCE: IMPURITIES | | | | | | | THICKNESS | | | | | |
| No. | Zn | Al | Mg | Ni | Si | OTHER | Fe | (μm) | (μm) | (μm) | TANCE | (kcps) | NOTE |
| 1 | 17.5 | 35.0 | 0 | 0.1 | 10.0 | — | 37.4 | 10.0 | 15.0 | 35.0 | A | 0.55 | EXAMPLE |
| 2 | 20.0 | 40.0 | 0.1 | 0.1 | 0 | — | 39.8 | 45.0 | 55.0 | 70.0 | A | 0.41 | EXAMPLE |
| 3 | 20.0 | 40.0 | 0.1 | 0.1 | 0.15 | — | 39.6 | 45.0 | 57.5 | 72.5 | A | 0.27 | EXAMPLE |
| 4 | 20.0 | 40.0 | 0.1 | 0.1 | 0 | — | 39.8 | 55.0 | 75.0 | 95.0 | AA | 0.47 | EXAMPLE |
| 5 | 20.0 | 37.5 | 0.1 | 0.1 | 0 | — | 42.3 | 60.0 | 80.0 | 100.0 | AA | 0.22 | EXAMPLE |
| 6 | 17.5 | 40.0 | 0.1 | 0.1 | 0 | — | 42.3 | 60.0 | 72.5 | 107.5 | AA | 0.36 | EXAMPLE |
| 7 | 20.0 | 37.5 | 0.1 | 0.1 | 0.15 | — | 42.1 | 65.0 | 77.5 | 97.5 | AA | 0.31 | EXAMPLE |
| 8 | 20.0 | 40.0 | 0.2 | 0.2 | 0.15 | — | 39.4 | 65.0 | 80.0 | 100.0 | AAA | 0.12 | EXAMPLE |
| 9 | 20.0 | 40.0 | 0.2 | 0.2 | 0.15 | — | 39.4 | 100.0 | 135.0 | 140.0 | AAA | 0.10 | EXAMPLE |
| 10 | 20.0 | 35.0 | 0 | 0.4 | 0 | — | 44.6 | 40.0 | 50.0 | 70.0 | A | 0.13 | EXAMPLE |
| 11 | 17.5 | 40.0 | 0.1 | 0.4 | 0 | — | 42.0 | 45.0 | 62.5 | 82.5 | AA | 0.13 | EXAMPLE |
| 12 | 20.0 | 40.0 | 0.1 | 0.2 | 0 | — | 39.7 | 45.0 | 57.0 | 97.0 | A | 0.11 | EXAMPLE |
| 13 | 20.0 | 37.5 | 0.1 | 0.2 | 3.00 | — | 39.2 | 20.0 | 25.0 | 30.0 | A | 0.33 | EXAMPLE |
| 14 | 20.0 | 35.0 | 0.2 | 0.3 | 0 | — | 44.5 | 70.0 | 90.0 | 130.0 | AAA | 0.15 | EXAMPLE |
| 15 | 20.0 | 35.0 | 0.2 | 0.3 | 0 | — | 44.5 | 65.0 | 87.5 | 107.5 | AAA | 0.10 | EXAMPLE |
| 16 | 20.0 | 42.5 | 0.1 | 0.1 | 0.15 | — | 37.1 | 40.0 | 55.0 | 85.0 | AA | 0.46 | EXAMPLE |
| 17 | 20.0 | 40.0 | 0.1 | 0.1 | 0.15 | — | 39.6 | 45.0 | 60.0 | 80.0 | S | 0.53 | EXAMPLE |
| 18 | 17.5 | 45.0 | 0.3 | 0.1 | 0 | — | 37.1 | 55.0 | 70.0 | 90.0 | S | 0.50 | EXAMPLE |
| 19 | 15.0 | 42.5 | 0.2 | 0.2 | 0.15 | — | 41.9 | 110.0 | 125.0 | 155.0 | S | 0.59 | EXAMPLE |
| 20 | 17.5 | 40.0 | 0.2 | 0.2 | 0.15 | — | 41.9 | 45.0 | 60.0 | 80.0 | S | 0.55 | EXAMPLE |

TABLE 4B

| | LOWER ALLOY LAYER | | | | | | | | THICKNESS OF ALLOY LAYER | THICKNESS OF PLATED-METAL-LAYER | PERFORMANCE CORROSION RESISTANCE | CI INTENSITY | |
|---|---|---|---|---|---|---|---|---|---|---|---|---|---|
| | COMPOSITION (MASS %) BALANCE: IMPURITIES | | | | | | | THICKNESS | | | | | |
| No. | Zn | Al | Mg | Ni | Si | OTHER | Fe | (μm) | (μm) | (μm) | TANCE | (kcps) | NOTE |
| 21 | 17.5 | 40.0 | 0.3 | 0.4 | 0 | — | 41.8 | 35.0 | 75.0 | 105.0 | S | 0.50 | EXAMPLE |
| 22 | 22.5 | 45.0 | 0.3 | 0.2 | 0 | — | 32.0 | 65.0 | 100.0 | 110.0 | S | 0.59 | EXAMPLE |
| 23 | 17.5 | 45.0 | 0.2 | 0.1 | 0 | — | 37.2 | 70.0 | 105.0 | 110.0 | S | 0.46 | EXAMPLE |
| 24 | 15.0 | 52.5 | 0.2 | 0.1 | 0 | — | 32.2 | 5.0 | 6.0 | 11.0 | A | 0.42 | EXAMPLE |
| 25 | 17.5 | 37.5 | 0.3 | 0.1 | 12.0 | — | 32.6 | 4.0 | 4.5 | 24.5 | B | 4.87 | COMPARATIVE EXAMPLE |
| 26 | 90.0 | 0 | 0 | 0.1 | 0 | — | 9.9 | 50.0 | 70.0 | 85.0 | B | 0.28 | COMPARATIVE EXAMPLE |
| 27 | 15.0 | 30.0 | 0.3 | 0.6 | 0.15 | — | 53.9 | 90.0 | 120.0 | 140.0 | B | 0.18 | COMPARATIVE EXAMPLE |

TABLE 4B-continued

| | LOWER ALLOY LAYER | | | | | | | | THICK-NESS | THICK-NESS OF PLATED- | PERFOR-MANCE | CI | |
|---|---|---|---|---|---|---|---|---|---|---|---|---|---|
| | COMPOSITION (MASS %) BALANCE: IMPURITIES | | | | | | | THICK-NESS | OF ALLOY LAYER | METAL-LAYER | CORROSION RESIS- | INTEN-SITY | |
| No. | Zn | Al | Mg | Ni | Si | OTHER | Fe | (μm) | (μm) | (μm) | TANCE | (kcps) | NOTE |
| 28 | 25.0 | 35.0 | 0.2 | 0 | 0 | Cr: 0.1% | 39.7 | 105.0 | 105.0 | 120.0 | B | 2.41 | COMPAR-ATIVE EXAMPLE |
| 29 | 20.0 | 35.0 | 0.1 | 0.1 | 0.15 | — | 44.6 | 40.0 | 55.0 | 85.0 | AAA | 0.27 | EXAMPLE |
| 30 | 20.0 | 35.0 | 0.1 | 0.1 | 0.15 | — | 44.6 | 45.0 | 60.0 | 80.0 | AAA | 0.36 | EXAMPLE |
| 31 | 0 | 40.0 | 0.1 | 0.4 | 2.50 | — | 57.0 | 35.0 | 50.0 | 65.0 | B | 1.29 | COMPAR-ATIVE EXAMPLE |
| 32 | 60.0 | 20.0 | 0.3 | 0.1 | 0 | — | 19.6 | 40.0 | 80.0 | 100.0 | B | 0.05 | COMPAR-ATIVE EXAMPLE |
| 33 | 60.0 | 22.5 | 0.3 | 0.4 | 0 | — | 16.8 | 85.0 | 85.0 | 105.0 | B | 0.04 | COMPAR-ATIVE EXAMPLE |
| 34 | 60.0 | 20.0 | 0.6 | 0.2 | 3.00 | — | 16.2 | 5.0 | 45.0 | 65.0 | B | 0.05 | COMPAR-ATIVE EXAMPLE |
| 35 | 60.0 | 20.0 | 0.7 | 0.1 | 0.15 | — | 19.0 | 50.0 | 90.0 | 120.0 | B | 0.04 | COMPAR-ATIVE EXAMPLE |
| 36 | 60.0 | 22.5 | 0.6 | 0.1 | 0.15 | — | 16.6 | 50.0 | 90.0 | 110.0 | B | 0.03 | COMPAR-ATIVE EXAMPLE |
| 37 | 10.0 | 50.0 | 0.3 | 0.1 | 0 | — | 39.6 | 80.0 | 80.0 | 100.5 | B | 0.03 | COMPAR-ATIVE EXAMPLE |

THE UNDERLINE INDICATES THAT THE VALUE IS OUT OF THE RANGE OF THE PRESENT INVENTION.

INDUSTRIAL APPLICABILITY

According to the present invention, a Zn—Al—Mg-based plated steel material excellent in corrosion resistance can be provided. As a result, it is possible to realize a steel structure which is capable of inexpensively and stably exhibiting the corrosion resistance even under severe corrosion resistance environment. Accordingly, the present invention has significant industrial applicability.

REFERENCE SIGNS LIST

1 Steel material
2 Plated-metal-layer
2*a* Surface of plated steel material (surface of plated-metal-layer)
2*b* Upper plated layer
2*c* Alloy layer

The invention claimed is:

1. A plated steel material comprising: a steel material; and a plated-metal-layer arranged on a surface of the steel material, wherein the plated-metal-layer includes: a lower alloy layer; an intermediate alloy layer; and an upper plated layer made of a Zn-based alloy including 0 to 5.0% of Fe arranged in this order from a side of the steel material, a thickness of the lower alloy layer is 5 μm or more, a thickness of the intermediate alloy layer is 1.0 μm or more, and a total thickness of the lower alloy layer and the intermediate alloy layer is 6 μm or more, the lower alloy layer includes, as a chemical composition, in terms of mass %, 5.0 to 30.0% of Zn,
30.0 to 55.0% of Al,
22.5 to 50.0% of Fe,
0 to 10.0% of Si,
0 to less than 0.5% of Ni,
0 to 1.0% of Mg, and
a balance including impurities, and the intermediate alloy layer includes, as a chemical composition, in terms of mass %, 5.0 to 35.0% of Zn,
25.0 to 60.0% of Al,
20.0 to 45.0% of Fe,
0 to 10.0% of Si,
0.5 to 10.0% of Ni,
0 to 1.0% of Mg,
0 to 2.0% in total of at least one of Ca, Sn, Bi, In, Y, La, Ce, Sr, B, P, Cr, Ti, Co, V, Nb, Cu, Mn, Mo, W, Zr, Ag, Li, Na, K, and Ba, and
a balance including impurities.

2. The plated steel material according to claim 1, wherein the upper plated layer includes, as a chemical composition, in terms of mass %, 6.0 to 25.0% of Al,
more than 3.0 to 12.5% of Mg,
0.001 to less than 0.5% of Ni,
0 to 1.5% of Si,
0 to 3.0% of Ca,
0 to 3.0% of Sn,
0 to 1.0% of Bi,
0 to 1.0% of In,
0 to 0.5% of Y,
0 to 0.5% of La,
0 to 0.5% of Ce,
0 to 0.5% of Sr,
0 to 1.0% of B,
0 to 0.5% of P, 0 to 0.25% of Cr,
0 to 0.25% of Ti,
0 to 0.25% of Co,
0 to 0.25% of V,
0 to 0.25% of Nb,
0 to 1.0% of Cu,
0 to 0.25% of Mn,
0 to 0.25% of Mo,
0 to 0.25% of W,
0 to 0.25% of Zr,
0 to 1.0% of Ag,
0 to 0.5% of Li,
0 to 0.05% of Na,
0 to 0.05% of K,
0 to 0.25% of Ba,
0 to 5.0% of Fe, and
a balance including more than 50% of Zn and impurities.

3. The plated steel material according to claim 2, wherein the upper plated layer satisfies a following formula (1) and a following formula (2), $$Mg/Al \leq 0.5 \quad (1)$$

$$2 \times Ca + Sr + Y + La + Ce \geq 0.05, \quad (2)$$

herein, in the formula (1) and the formula (2), each of Mg, Al, Ca, Sr, Y, La, and Ce is a content (mass %) in the upper plated layer, and substituted with 0 when the element is not included.

* * * * *